US008740342B2

(12) United States Patent
Kitazawa

(10) Patent No.: US 8,740,342 B2
(45) Date of Patent: Jun. 3, 2014

(54) TEST APPARATUS FOR LIQUID DROP EMISSION APPARATUS

(71) Applicant: Seiko Epson Corporation, Tokyo (JP)

(72) Inventor: Koji Kitazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/742,139

(22) Filed: Jan. 15, 2013

(65) Prior Publication Data

US 2013/0187975 A1 Jul. 25, 2013

(30) Foreign Application Priority Data

Jan. 23, 2012 (JP) ..... 2012-010775

(51) Int. Cl.
*B41J 2/12* (2006.01)
*B41J 2/05* (2006.01)

(52) U.S. Cl.
USPC ..... 347/19; 347/56

(58) Field of Classification Search
CPC .. B41J 29/393; B41J 2/17546; B41J 2/04541; B41J 2/04548; B41J 2/2135
USPC ..... 347/19, 56
See application file for complete search history.

(56) References Cited

U.S. PATENT DOCUMENTS 7,429,093 B2 9/2008 Shinkawa ..... 347/19
7,744,197 B2 * 6/2010 Yamada et al. ..... 347/68

FOREIGN PATENT DOCUMENTS

JP 2005-305992 11/2005
JP 2011-189656 9/2011
JP 2012-179879 9/2012

* cited by examiner

*Primary Examiner* — Lisa M Solomon
(74) *Attorney, Agent, or Firm* — DLA Piper LLP (US)

(57) ABSTRACT

A test apparatus for a liquid drop emission apparatus having a plurality of emission mechanisms, the emission mechanisms each having a driving element configured to emit an ink drop from a nozzle, and an application switch coupled with a driving voltage source and the driving element in series, the application switch being configured to switch a driving voltage for emission of a liquid drop between being applied and not being applied to the driving element, the test apparatus including a test switch configured to make each of the emission mechanisms output a test voltage which appears between both ends of the application switch to a test terminal, the test apparatus including a failure deciding section configured to decide whether the emission mechanism is in failure or not on the basis of the test voltage outputted to the test terminal.

6 Claims, 11 Drawing Sheets

| n / A | ••• | 31 | 32 | 33 | 34 | 35 | 36 | ••• |
|---|---|---|---|---|---|---|---|---|
| ⋮ | ⋮ | ⋮ | ⋮ | ⋮ | ⋮ | ⋮ | ⋮ | ⋮ |
| 205 | ••• | NG $0\triangle_{205}$ | NG $0\triangle_{205}$ | NG $0\triangle_{205}$ | | | | ••• |
| 206 | ••• | OK $1\triangle_{205}$ | PAUSE $0\triangle_{205}$ | OK $1\triangle_{205}$ | | | | ••• |
| 207 | ••• | OK 2○ | PAUSE 0× | OK 2○ | | | | ••• |
| 208 | ••• | | | | PAUSE 0 | OK 1 | OK 1 | ••• |
| 209 | ••• | | | | PAUSE 0 | OK 2○ | OK 2○ | ••• |
| 210 | ••• | | | | NG $0(\triangle_{210})$× | NG $2(\triangle_{210})$○ | NG $2(\triangle_{210})$○ | ••• |
| ⋮ | ⋮ | ⋮ | ⋮ | ⋮ | ⋮ | ⋮ | ⋮ | ⋮ |

FIG. 11A

| A \ n | ••• | 31 | 32 | 33 | ••• |
|---|---|---|---|---|---|
| ⋮ | ⋮ | ⋮ | ⋮ | ⋮ | ⋮ |
| 205 | ••• | SMALL OK 1 | | | ••• |
| 206 | ••• | LARGE OK 2○ | | | ••• |
| 207 | ••• | | LARGE OK 1 | | ••• |
| 208 | ••• | | NO EMISSION 1 | | ••• |
| 209 | ••• | | MIDDLE OK 2○ | | ••• |
| 210 | ••• | | | MIDDLE NG × | ••• |
| ⋮ | ⋮ | ⋮ | ⋮ | ⋮ | ⋮ |

FIG. 11B

| A \ n | ••• | 31 | 32 | 33 | ••• |
|---|---|---|---|---|---|
| ⋮ | ⋮ | ⋮ | ⋮ | ⋮ | ⋮ |
| 205 | ••• | SMALL OK 0.5 | | | ••• |
| 206 | ••• | LARGE OK 2○ | | | ••• |
| 207 | ••• | | LARGE OK 1.5 | | ••• |
| 208 | ••• | | NO EMISSION 1.5 | | ••• |
| 209 | ••• | | MIDDLE OK 2.5○ | | ••• |
| 210 | ••• | | | SMALL OK 0.5 | ••• |
| ⋮ | ⋮ | ⋮ | ⋮ | ⋮ | ⋮ |

TEST APPARATUS FOR LIQUID DROP EMISSION APPARATUS

BACKGROUND

1. Technical Field

The present invention relates to a test apparatus for a liquid drop emission apparatus which emits a liquid drop from every liquid drop emission mechanism.

2. Related Art

A printer which drives a driving element to emit an ink drop on each of a plurality of emission mechanisms is tested for normal emission of an ink drop from a nozzle, as disclosed in JP-A-2005-305992. According to JP-A-2005-305992, a transistor ("transistor 44" in JP-A-2005-305992) whose ground side electrodes of plural driving elements are coupled with one another in common is provided, and plural emission mechanisms are each made emit an ink drop while the transistor is being kept on. Meanwhile, the driving elements to be tested are driven one by one while the transistor is being kept off, so that the emission mechanisms are tested one by one.

As, however, currents having gathered from the respective plural driving elements to emit ink drops pass through the transistor and flow into the ground while the transistor is being kept on, an element of a large current capacity has to be used for the transistor. Thus, there are problems in that the transistor has to be mounted independently as one of electronic parts, that space or wiring has to be secured for the transistor, and that a circuit for a decision on failure in the plural emission mechanisms cannot be downsized. Further, as whether an emission mechanism is in failure or not is decided on the basis of a voltage on a line where the ground side electrodes of the plural driving elements are coupled with one another in common in the wiring, an emission mechanism not to be tested cannot emit ink. That is, there is a problem in that only one driving element to be tested can emit an ink drop and the driving elements cannot be tested in a period of time for carrying out any printing job.

SUMMARY

An advantage of some aspects of the invention is to provide a test apparatus which decides whether each of plural driving mechanisms is in failure or not by means of a downsized circuit.

In order to achieve the above advantage, the liquid drop emission apparatus of the invention has a plurality of emission mechanisms each having a driving element configured to emit a liquid drop from a nozzle and an application switch. The application switch is coupled with a driving voltage source and the driving element in series. Then, the application switch switches a driving voltage for ink drop emission between being applied and not being applied to the driving element. A test switch makes each of the plural emission mechanisms output to a test terminal a test voltage which appears between both ends of the application switch to apply the driving voltage to the driving element. A failure deciding section decides whether the emission mechanism is in failure or not on the basis of the test voltage outputted to the test terminal.

If the driving voltage is applied to the driving element in the above configuration, the application switch turns conductive between the both ends, and a particular resistance value appears between the both ends of the application switch. Thus, when the driving voltage is applied to the driving element, a current flows between the both ends of the application switch in response to residual vibration of the driving element, and a test voltage appears in proportion to the current. That is, the failure deciding section can obtain the test voltage according to the residual vibration of the driving element, and decide whether the emission mechanism is in failure or not on the basis of the test voltage. As the plural emission mechanism are each provided with the test switch, a quantity of the current which flows through the test switch can be controlled. Thus, the test switch can be implemented by an element of a small current, and the test apparatus including the test switch can be downsized. Further, as the emission mechanisms are each provided with a test switch, a voltage caused by the residual vibration of the driving element in an emission mechanism not to be tested can be cut off by the test switch. Thus, the emission mechanism not to be tested can emit a liquid drop without disturbing the test on the emission mechanisms, and the emission mechanisms can be tested even while any printing job is being run.

Further, a shift register configured to shift nozzle selection data formed by emission feasibility data serially combined in order of the plural emission mechanisms may be provided. The emission feasibility data specifies whether a liquid drop is to be emitted or not for each of the plural emission mechanisms. The shift register outputs a control signal based on the emission feasibility data from a data output terminal to the application switch of each of the emission mechanisms. Further, the application switch and the test switch may be controlled by the control signal outputted from the same data output terminal of the shift register in each of the emission mechanisms. It is thereby needless to provide shift registers for controlling the application switch and the test switch individually, and an emission head can be downsized.

Further, a separate shift register for controlling the test switch may be provided without regard to the case where the application switch and the test switch are controlled by the same shift register. Emission mechanisms in each of which the driving voltage is applied to the driving element may be chosen one by one, and a test voltage may be obtained from the chosen emission mechanism. An emission mechanism in which the test voltage is irregular can be uniquely identified.

Further, the failure deciding section, the test switch, the application switch and the shift register may be included in a single semiconductor integrated circuit. The test apparatus can thereby be downsized at lower cost.

Further, the one end of the application switch may be given a known voltage and the other end of the application switch may be coupled with the driving element in each of the plural emission mechanisms. Then, the test switch may switch the other end of the application switch between being coupled and decoupled with the test terminal. If the one end of the application switch is given a known voltage, the voltage on the other end of the application switch can be measured on the test terminal so that the test voltage between the both ends of the application switch can be obtained according to a difference between the measured voltage and the known voltage.

Further, the one end of the application switch may be grounded, i.e., given a known voltage, in each of the plural emission mechanisms. That is, the test voltage can be easily obtained according to a difference between the ground level and the voltage on the other end of the application switch.

Further, if a voltage pattern of the driving voltage is known, the one end of the application switch may be coupled with the driving voltage source in each of the plural emission mechanisms. That is, the test voltage may be obtained according to a difference between the known voltage pattern and the voltage on the other end of the application switch.

BRIEF DESCRIPTION OF THE DRAWINGS

The invention will be described with reference to the accompanying drawings, wherein like numbers reference like elements.

FIGS. 11A and 11B show test tables of the third modification.

DESCRIPTION OF EXEMPLARY EMBODIMENTS

Figure 1:
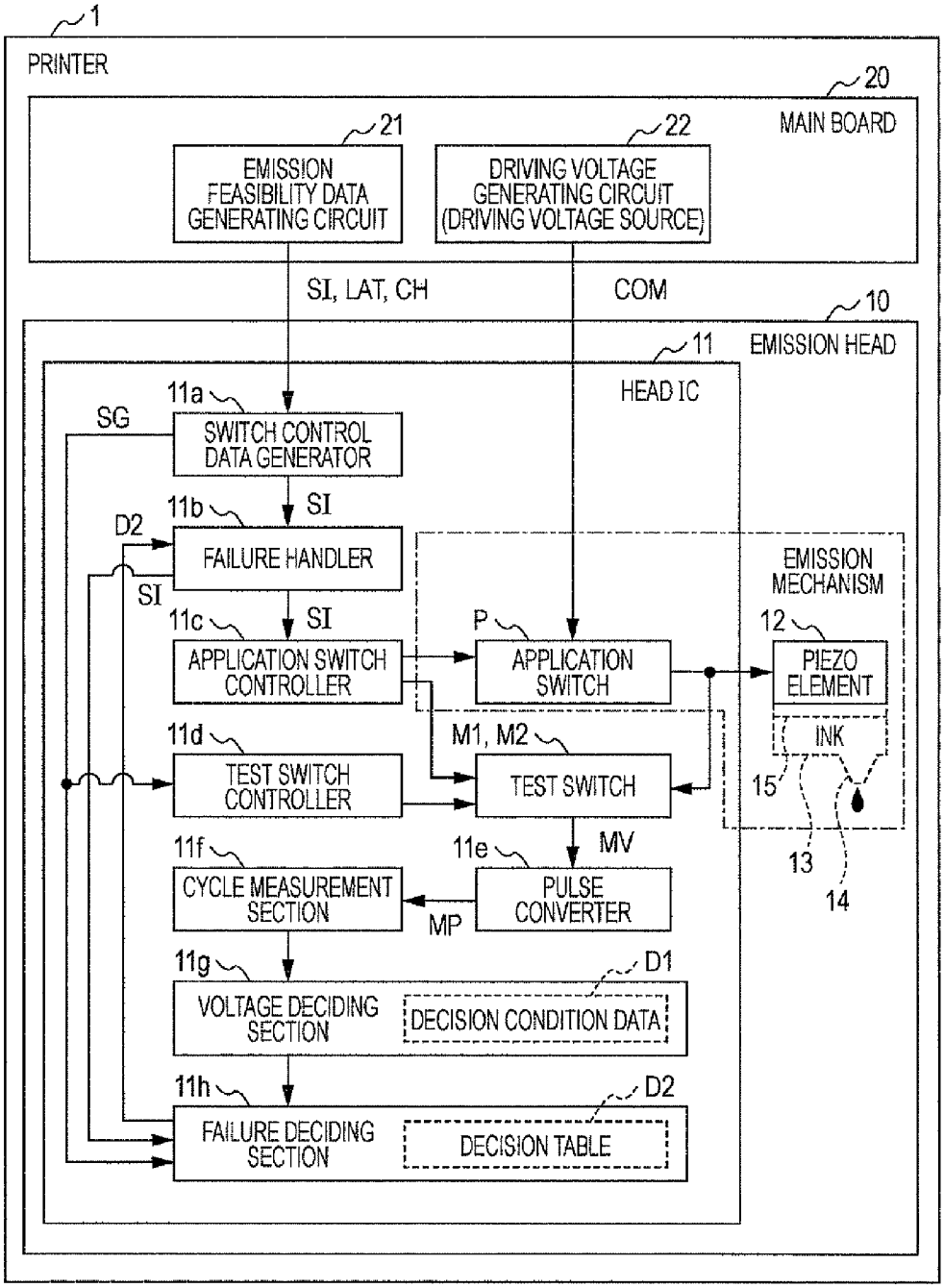
FIG. 1 is a block diagram of a printer including a test apparatus.

Embodiments of the invention will be explained below in order shown below.

(1) First Embodiment
(1-1) Configuration of printer
(1-2) Test processing
(1-3) Failure handling processing
(2) First modification
(3) Second modification
(4) Third modification
(5) Other modifications

(1) Configuration of Printer

FIG. 1 is a block diagram to show a configuration of a printer 1, a liquid drop emission apparatus, including a test apparatus of an embodiment of the invention. The printer 1 has an emission head 10 and a main board 20. The main board 20 has an emission feasibility data generating circuit 21 and a driving voltage generating circuit 22. The emission feasibility data generating circuit 21 is a circuit which generates emission feasibility data SI to specify whether plural driving mechanisms that the emission head 10 has are each made emit an ink drop, i.e., a liquid drop, or not. The emission feasibility data generating circuit 21 provides the emission head 10 with nozzle selection data formed by the emission feasibility data SI serially combined in order of the plural emission mechanisms. Further, the emission feasibility data generating circuit 21 generates the emission feasibility data SI for each of plural emission timings and outputs the emission feasibility data SI in order of the emission timings. Incidentally, the emission timing is a timing in which the plural emission mechanisms that the emission head 10 has emit ink drops at the same time while a printing job is being carried out. Further, the emission feasibility data generating circuit 21 generates a latch signal LAT and a switching signal CH so as to provide the emission head 10 with the generated signals. The latch signal LAT is a timing signal to specify emission timings. The switching signal CH is a timing signal to specify periods of time into which the emission timing is divided.

The driving voltage generating circuit 22 is a circuit (driving voltage source) to generate a driving voltage COM for driving a piezo element 12, a driving element that the emission head 10 has. The driving voltage generating circuit 22 has a D/A converter which generates the driving voltage COM on the basis of digital data to specify a voltage pattern of the driving voltage and an amplifier which amplifies the driving voltage COM having been D/A-converted. The driving voltage generating circuit 22 provides an application switch P of the emission head 10 with the driving voltage COM outputted by the driving voltage generating circuit 22.

Figure 2B:
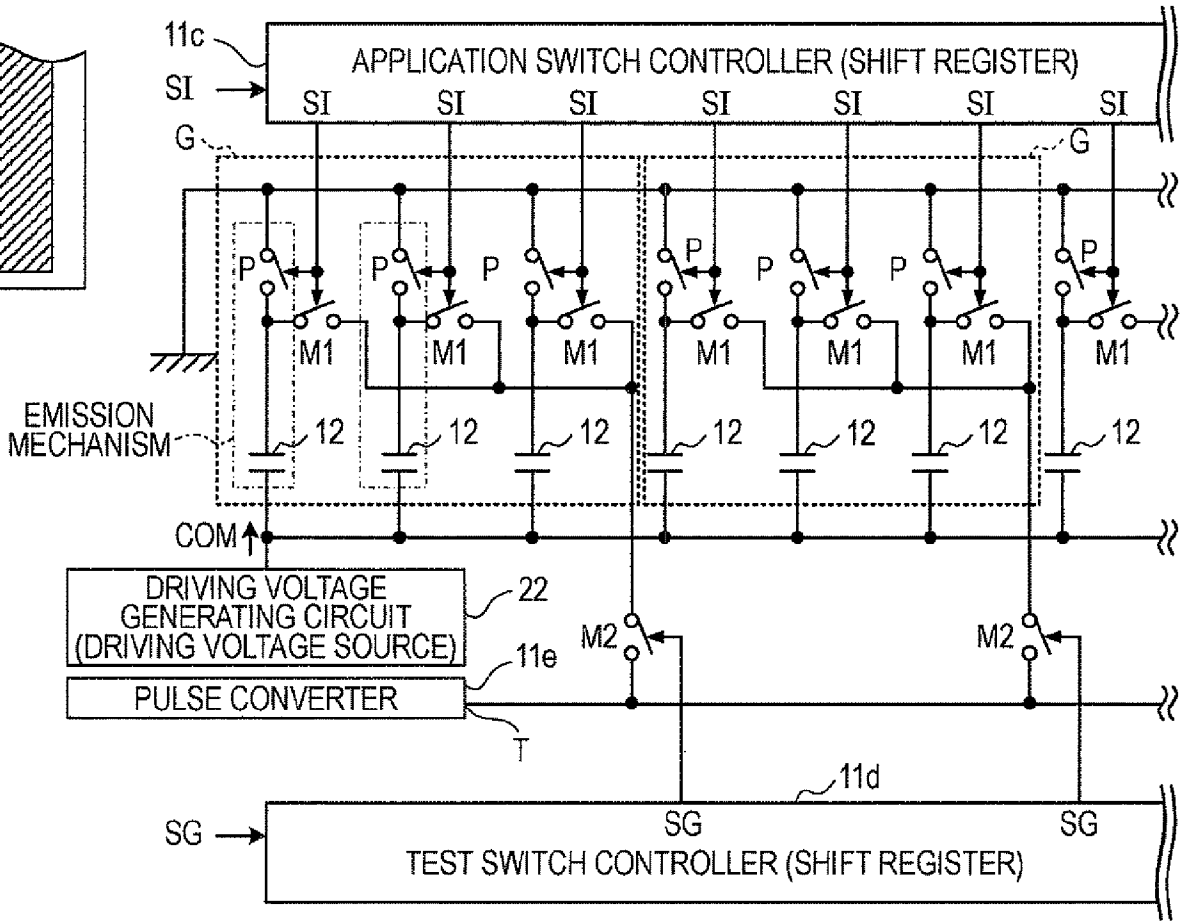
FIG. 2B is a circuit diagram of an emission head.
Figure 2A:
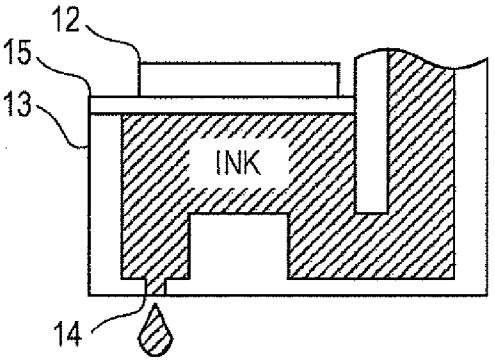
FIG. 2A is a schematic diagram of an emission mechanism.

FIG. 2A is a schematic diagram to show a configuration of a driving mechanism that the emission head 10 has. FIG. 2B is a circuit diagram of a portion of the emission head 10. As shown in FIG. 1, the emission head 10 has a head IC 11, the piezo element 12, an ink chamber 13, a nozzle 14 and a vibration plate 15. The emission head 10 has a plurality (not shown) of emission mechanisms which each have the piezo element 12, the ink chamber 13, the nozzle 14 and the vibration plate 15 as shown in FIG. 2A. The number of the provided emission mechanisms of the embodiment is 90 for each of ink colors, C (cyan), M (magenta), Y (yellow) and B (black), and is 360 (=N) in all. The piezo element 12 is a piezoelectric element. If the driving voltage COM is applied to the piezo element 12, the piezo element 12 is mechanically distorted so as to make the vibration plate 15 which forms a wall of the ink chamber 13 filled with ink vibrate. The inside of the ink chamber is thereby pressurized or decompressed, and the ink in the ink chamber turns an ink drop and is emitted from the nozzle 14. The application switch P is a switch to switch the driving voltage COM between being applied and not being applied to the piezo element 12 in each of the plural emission mechanisms. That is, the application switch P applies the driving voltage COM selectively to a piezo element 12 corresponding to a nozzle 14 to emit an ink drop as specified by the emission feasibility data SI.

In each of the plural emission mechanisms (dot-and-dash lines) shown in FIG. 2B, a line that the driving voltage COM is transferred through, the piezo element 12, the application switch P and the ground are coupled with one another in series. The application switch P couples a source and a drain in series with and between the piezo element 12 and the ground. Thus, the driving voltage COM is applied to the piezo element 12 if the application switch P is on, and the driving voltage COM is not applied to the piezo element 12 if the application switch P is off. Further, the application switch P has a resistance component of a value specific to the element while being kept on. Thus, if a current flows from the piezo element 12 in a period of time when the application switch P is on, a voltage (called test voltage, hereafter) appears between the source and the drain of the application switch P in proportion to the current.

In each of the plural emission mechanisms, a test switch M1 is coupled with and between the piezo element 12 and the application switch P. In each of the plural emission mechanisms, the application switch P and the test switch M1 are coupled with a same data output terminal of an application switch controller 11*c*. Thus, in each of the plural emission mechanisms, the application switch P and the test switch M1 are controlled by a control signal based on the same emission feasibility data SI. As shown in FIG. 28, terminals of every three test switches M1 not coupled with the application switches P are electrically coupled with one another, and the three test switches M1 are coupled with a test switch M2 in common. Three (=M) emission mechanisms which each include the application switch P coupled with the common test switch M2 via the test switch M1 form a group G indicated by a dashed line. That is, the group G of the embodiment is formed by three (=M) emission mechanisms. The test switch M2 is provided to every group G. The plural test switches M2 are each coupled with a test terminal T of a pulse converter 11*e* through a common line. If the test switch M2 is on and S test switches M1 (where a symbol "S" represents the number of what comes next, and is a natural number <=3 (=M)) coupled with the relevant test switch M2 are on, source-drain test voltages of S application switches P each being coupled with each of the S test switches M1 join together to be a joint test voltage MV to be provided to the test terminal T of the pulse converter 11*e*. Incidentally, voltage drops caused by the resistance components in the test switches M1 and M2 are neglected. The term joint means that voltage waveforms of plural test voltages are combined with one another to be the joint test voltage MV.

As shown in FIG. 1, the head IC 11 has a switch control data generator 11*a*, a failure handler 11*b*, the application switch controller 11*c*, the application switch 2, a test switch controller 11*d*, the test switches M1 and M2, the pulse converter 11*e*, a cycle measurement section 11*f*, a voltage deciding section 11*g* and a failure deciding section 11*h*. The head IC 11 is an SOC (System on a chip), etc., such that a single semiconductor integrated circuit includes a digital signal processing circuit, an analog signal processing circuit, a RAM, etc.

The switch control data generator 11*a* provides the failure handler 11*b* on a later stage with the emission feasibility data SI. The failure handler 11*b* corrects the emission feasibility data SI if the emission feasibility data SI indicates that an emission mechanism in failure definitely judged to be in failure by test processing described later is made emit an ink drop, and that a normal emission mechanism definitely judged to be normal is prevented from emitting an ink drop. That is, the failure handler 11*b* corrects the emission feasibility data SI so as to substitute the emission mechanism in failure with the normal emission mechanism to be made emit an ink drop, and provides the application switch controller 11*c* on a later stage with the corrected SI. The failure handler 11*b* of the embodiment substitutes an emission mechanism in failure with a normal emission mechanism located next to the emission mechanism in failure to be made emit an ink drop.

Figure 3A:
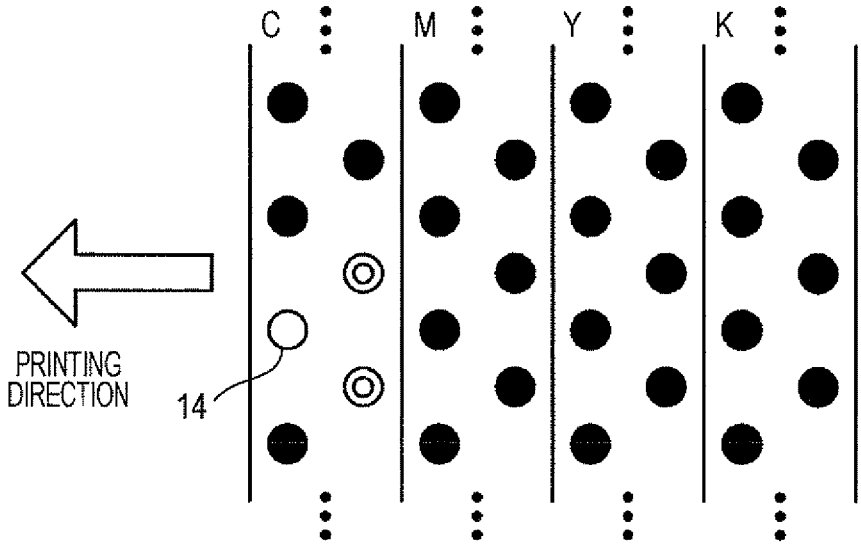
FIG. 3A shows nozzles.

FIG. 3A shows an arrangement of the nozzles 14 on a face (nozzle face) of the head IC 11 to be put opposite a recording medium. The head IC 11 of the embodiment is a line head and is provided with two nozzle lines formed by a plurality of the nozzles 14 for every ink color perpendicularly to a transport direction (printing direction) of the recording medium. In each of the nozzle lines, the nozzles 14 are arranged at regular intervals in the direction perpendicular to the printing direction. Further, the nozzles 14 are displaced in the direction perpendicular to the printing direction by half the interval from each other between the nozzle lines being adjacent to each other in the printing direction. The normal emission mechanism corresponds to any one of two emission mechanisms each having a nozzle 14 (indicated by a double circle) which emits an ink drop of a same ink color as that of the emission mechanism in failure and is located closest (half the interval apart) to a nozzle 14 (indicated by a circle) that the emission mechanism in failure has in the direction perpendicular to the printing direction.

The failure handler 11*b* obtains a decision table D2 which indicates whether each of the plural emission mechanisms are in failure or not at each of emission timings in a printing job, and identifies an emission mechanism to be made emit an ink drop at the relevant emission timing on the basis of the emission feasibility data SI. Then, if the emission mechanism to be made emit an ink drop is an emission mechanism in failure, the failure handler 11*b* substitutes the relevant emission mechanism in failure with a normal emission mechanism being adjacent to the relevant emission mechanism in failure to be made emit an ink drop. Incidentally, as the failure deciding section 11*h* updates the decision table D2 at each of emission timings in a printing job, the failure handler 11*b* substitutes the emission mechanism in failure judged to be in failure by the failure deciding section 11*h* at an A-th emission timing (where "A" is a positive integer and "A-th" is an ordinal) with the normal emission mechanism at an (A+1)-th emission timing. Incidentally, as the emission feasibility data SI is outputted to the emission mechanism at each of emission timings, the piezo element 12 of the emission mechanism is controlled at the A-th emission timing on the basis of the A-th emission feasibility data SI.

The application switch controller 11*c* includes a shift register which restores the emission feasibility data SI for every emission mechanism by converting nozzle selection data formed by serially joined emission feasibility data SI into parallel data. That is, the application switch controller 11*c* has plural registers each corresponding to each of the plural emission mechanisms, and holds the emission feasibility data SI by means of the relevant plural registers by shifting the nozzle selection data through the relevant plural registers every cycle of a particular clock signal. Then, the application switch controller 11*c* is synchronized with the latch signal LAT and the switching signal CH so as to control and set a signal level of a control signal to 1 or 0 at a data output terminal coupled with the application switch P on the basis of the emission feasibility data SI held by each of the plural registers. The application switch P is thereby switched between being on (control signal: 1) and off (control signal: 0) on each of the plural emission mechanisms, and the piezo element 12 is switched between being made emit an ink drop and made emit no ink drop.

Figure 3B:
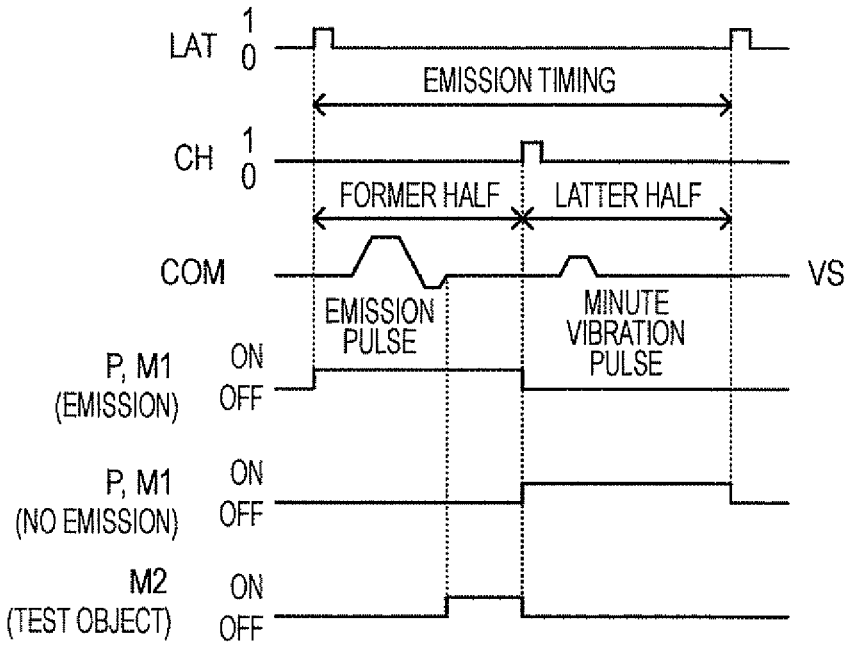
FIG. 3B is a timing chart which shows operations of switches.

FIG. 3B is a timing chart which shows the driving voltage COM and operations of the respective switches P, M1 and M2. The driving voltage generating circuit 22 of the embodiment generates the driving voltage COM which includes an emission pulse for driving the piezo element 12 to emit an ink drop and a minute vibration pulse for driving the piezo element 12 to slightly vibrate to such an extent that no ink drop is emitted at each of emission timings. Incidentally, a voltage pattern generated by the driving voltage generating circuit 22 comes to a known reference voltage VS for a period of time excepting periods of time for emission pulse and minute vibration pulse outputs. The emission timing is a period of time between timings when successive two pulses of the latch signal LAT rise. The switching signal CH is a timing signal which rises in the middle of the emission timing and draws a line between a former half and a latter half of the emission timing. Incidentally, the driving voltage COM includes the emission pulse and the minute vibration pulse in the former and latter halves of the emission timing, respectively.

Upon being provided with emission feasibility data SI to emit an ink drop, the application switch controller 11*c* controls a signal level of a control signal on a data output terminal on the basis of the emission feasibility data SI so that the application switch P and the test switch M1 are on and off in the former and latter halves of the emission timing, respectively. That is, let the signal level of the control signal be 1 and 0 in the former and latter halves of the emission timing, respectively, on the data output terminal corresponding to an emission mechanism to emit an ink drop. An emission pulse can thereby be applied to the piezo element 12 so as to emit an ink drop in the former half of the emission timing. Meanwhile, upon being provided with emission feasibility data SI not to emit an ink drop, the application switch controller 11*c* controls a signal level of a control signal on a data output terminal on the basis of the emission feasibility data SI so that the application switch P and the test switch M1 are off and on in the former and latter halves of the emission timing, respectively. That is, let the signal level of the control signal be 0 and 1 in the former and latter halves of the emission timing, respectively, on the data output terminal corresponding to an emission mechanism not to emit an ink drop. A minute vibration pulse can thereby be applied to the piezo element 12 in the latter half of the emission timing, so that the vibration plate 15 vibrates to such an extent that no ink drop is emitted. Retention of ink in the ink chamber 13 can thereby be prevented even in an emission mechanism not to emit an ink drop.

The switch control data generator 11*a* generates test control data SG and outputs the test control data SG to the test switch controller 11*d* as shown in FIG. 1. The test switch controller lid includes a shift register which converts serial data of the test control data SG into parallel data and outputs the test control data SG to the test switches M2 provided correspondingly to the relevant plural groups G as shown in FIG. 2B. The switch control data generator 11*a* chooses one of the groups G to be tested at each of emission timings, and generates the test control data SG to turn on only the test switch M2 corresponding to the relevant group G. Thus, source-drain test voltages of application switches P of S emission mechanisms out of 3 (=M)) emission mechanisms which form the group G to be tested join together to be a joint test voltage MV to be provided to the test terminal T of the pulse converter 11*e*. The switch control data generator 11*a* can consecutively choose one and the same group G to be tested for plural emission timings.

The test switch M2 corresponding to the group G to be tested is controlled on the basis of the test control data SG so as to be on for a period of time between the end of the period of time for the emission pulse output and the end of the former half of the emission timing as shown on the bottom row in FIG. 3B. The joint test voltage MV which indicates a state of residual vibration of the vibration plate 15 immediately after the period of time for the emission pulse output in which the vibration plate 15 is forced to vibrate can thereby be obtained. That is, the joint test voltage MV in which test voltages each corresponding to the residual vibration of the piezo element 12 immediately after ink drop emission in the emission mechanism having emitted an ink drop join together on a group G-by-group G basis can be obtained. Incidentally, a change in parasitic capacitance of the piezo element 12 caused by residual vibration of the vibration plate 15 makes a current flow between the piezo element 12 and the ground, and a test voltage which is proportional to the current appears between the source and the drain of the application switch P. Meanwhile, as the test switch M1 is off throughout the period of time when the test switch M2 is on in the emission mechanism belonging to the group G to be tested not to emit an ink drop, a voltage generated on the application switch P of the relevant emission mechanism can be prevented from being a noise source for the joint test voltage MV. As the test switch M2 is off all the time in the group G not to be tested, a voltage generated on the application switch P of the emission mechanism belonging to the group G not to be tested can be similarly prevented from being a noise source for the joint test voltage MV.

The pulse converter 11*e* is a circuit which generates a test pulse MP by amplifying the joint test voltage MV provided to the test terminal T and rendering the amplified joint test voltage MV binary depending upon whether it is higher or lower than a threshold voltage. Incidentally, as one end of application switch P is grounded, the voltage on the test terminal T can be obtained as the joint test voltage MV which appears between the source and the drain of the application switch P.

Figures 4A, 4B:
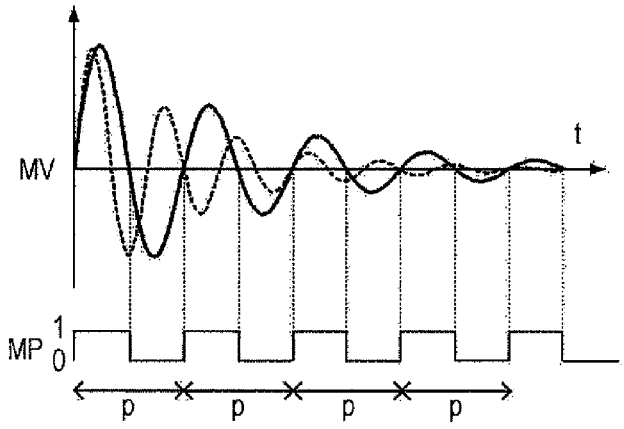
FIG. 4A is a graph of a joint test voltage.
FIG. 4B shows a test table.

FIG. 4A is a graph which shows the joint test voltage MV and the test pulse MP. The pulse converter 11*e* generates the test pulse MP given a signal level 1 for a period of time when the joint test voltage MV is equal to or higher than the threshold voltage set to the middle of the amplitude and given a signal level 0 for a period of time when the joint test voltage MV is lower than the threshold voltage. The joint test voltage MV has a periodic waveform whose amplitude decays as time t passes. The joint test voltage MV vibrates, owing to the residual vibration, with a cycle p which depends upon a natural frequency of the vibration plate 15. The natural frequency in case of an air bubble got mixed in the ink chamber is higher than that in case of no mixed air bubble. Thus, if an air bubble is got mixed in the ink chamber, the cycle p of the joint test voltage MV is shortened.

The cycle measurement section 11*f* measures an interval since a rise of a test pulse MP and until a rise of a next test pulse MP as the cycle p. If plural values of the cycle p are measured, the cycle measurement section 11*f* may provide the voltage deciding section 11*g* with an average of the plural cycles p as the cycle p. The voltage deciding section 11*g* obtains a normal range of the cycle p and decides whether the cycle p provided by the cycle measurement section 11*f* belongs to the normal range with reference to decision condition data D1. Unless the cycle p provided by the cycle measurement section 11*f* belongs to the normal range, the voltage deciding section 11*g* decides that the joint test voltage MV is irregular. Meanwhile, if the cycle p provided by the cycle measurement section 11*f* belongs to the normal range, the voltage deciding section 11*g* decides that the joint test voltage MV is normal.

The failure deciding section 11*h* obtains the test control data SG from the emission feasibility data generating circuit 21, and identifies a group G to be tested on the basis of the test control data SG. Further, the failure deciding section 11*h* obtains the emission feasibility data SI from the failure handler 11*b*, and identifies S emission mechanisms in operation each having emitted an ink drop out of three(=M) emission mechanisms belonging to the group G to be tested on the basis of the emission feasibility data SI. The failure deciding section 11*h* records a resultant decision on the joint test voltage MV regarding the emission mechanism belonging to the group G to be tested in the decision table D2.

FIG. 4B shows the decision table D2 recorded by the failure deciding section 11*h*. Test results are recorded in the decision table D2 shown in FIG. 4B for every combination of a numeral n (its maximum is N) specifically given to each of the emission mechanisms and a numeral A of emission timing corresponding to the emission timing. The columns of numeral n corresponding to the emission mechanisms excepting the three emission mechanisms belonging to the group G to be tested are each given diagonal lines in the decision table D2 shown in FIG. 4B. Further, a column of a numeral n included in the three columns belonging to the group G to be tested having emitted no ink drop is given a sign "pause".

Meanwhile, a column of a numeral n included in the three columns belonging to the group G to be tested having emitted an ink drop is given a sign "OK" (i.e., normal) or "NG" (i.e., in failure) which is a resultant decision on the joint test voltage MV.

If the joint test voltage MV is normal, the failure deciding section 11*h* provisionally decides that all the S emission mechanisms in operation are normal, and adds one to the number of times of being normal for all the S emission mechanisms. Then, the failure deciding section 11*h* definitely decides that an emission mechanism whose number of times of being normal has reached a certain threshold for being normal is normal. Let the threshold for being normal of the embodiment be two. It is decided in the decision table D2 shown in FIG. 45, e.g., that the joint test voltage MV is normal for the 31st (=n-th) emission mechanism at 206th and 207th (=A-th) emission timings, and the number of times of being normal is two at the 207th emission timing. Thus, it is definitely decided that the 31st emission mechanism is normal at the 207th emission timing. Incidentally, a column corresponding to the numeral n of the emission mechanism definitely judged to be normal is given a circular sign in the decision table D2 shown in FIG. 4B.

If the number of emission mechanisms in operation is one in the group G and the joint test voltage MV is irregular, the failure deciding section 11*h* definitely decides that the one emission mechanism in operation is in failure. Incidentally, an emission mechanism in failure of the embodiment means one in which a bubble is included in the ink chamber 13 resulting in that the volume of an ink drop is smaller than normal. Further, if the number of the emission mechanisms in operation is equal to or more than two (S>=2) in the group G to be tested and the joint test voltage MV is irregular, the failure deciding section 11*h* provisionally decides that one of the S emission mechanisms in operation is in failure and enumerates all the S emission mechanisms as candidates for being in failure. Although all the three (=S) 31st-33rd emission mechanisms each emits an ink drop at the 205th emission timing, all the three emission mechanisms are enumerated as candidates for being in failure as the joint test voltage MV is irregular, e.g., in the decision table D2 shown in FIG. 4B. Incidentally, the column corresponding to the numeral n of the emission mechanism enumerated as a candidate for being in failure is given a triangular sign with a subscript which indicates the numeral A of the emission timing at which the emission mechanism is enumerated as the candidate for being in failure in the decision table D2 shown in FIG. 4B.

Upon enumerating all the S emission mechanisms as candidates for being in failure and definitely deciding that (S−1) emission mechanisms out of the S emission mechanisms excluding one emission mechanism are normal, the failure deciding section 11*h* definitely decides that the excluded one emission mechanism is in failure. All the three (=S) 31st-33rd emission mechanisms are enumerated as candidates for being in failure at the 205th emission timing in the decision table D2 shown in FIG. 45. After that, the number of times of being normal of the 31st and 33rd emission mechanisms is two at the 207th emission timing, and it is definitely decided that the two (=S−1) 31st and 33rd emission mechanisms are normal. It is definitely decided in this case that the 32nd emission mechanism out of the three (=S) 31st-33rd emission mechanisms enumerated as candidates for being in failure at the 205th emission timing excepting the two (=S−1) 31st and 33rd emission mechanisms definitely judged to be normal at the 207th emission timing is in failure. The column corresponding to the numeral n of the emission mechanism definitely judged to be in failure is given an X sign in the decision table D2 shown in FIG. 4B.

Upon definitely deciding that all the three (=M) emission mechanisms belonging to the group G to be tested are each normal or in failure, the failure deciding section 11*h* allows a next group G to be chosen as an object to be tested. It is followed by that the switch control data generator 11*a* generates test control data SG to turn on the test switch M2 corresponding to the next group G immediately after the emission pulse at the next emission timing. Meanwhile, the failure deciding section 11*h* does not allow a next group G to be chosen as an object to be tested without definitely deciding that all the three (=M) emission mechanisms belonging to the group G to be tested are each being normal or in failure. It is followed by that the switch control data generator 11*a* successively generates the test control data SG to turn on the test switch M2 corresponding to the current group G to be tested immediately after the emission pulse at the next emission timing. Thus, upon identifying S emission mechanisms as candidates for being in failure, the failure deciding section 11*h* repeats a process for deciding whether the joint test voltage MV is normal or not for the group G until it is decided that the (S−1) emission mechanisms out of the S emission mechanisms enumerated as the candidates for being in failure excepting one emission mechanism are normal.

If the driving voltage COM is applied to the piezo element 12 in the configuration of the embodiment described above, the application switch P turns conductive between the source and the drain, and a particular resistance value appears between the source and the drain. Thus, a current flows between the source and the drain of the application switch P in response to residual vibration of the piezo element 12 and a test voltage appears in proportion to the current. That is, the failure deciding section 11*h* can obtain the test voltage according to the residual vibration of the piezo element 12, and decide whether the emission mechanism is in failure or not on the basis of the test voltage. As the plural emission mechanisms are each provided with the test switch M1, a quantity of the current which flows through the test switch M1 can be controlled. Thus, the test switch M1 can be implemented by an element of a small current and the head IC 11 including the test switch M1 can be downsized. Further, as the emission mechanisms are each provided with a test switch M1, the voltage which appears on the application switch P of the emission mechanism belonging to the group G having emitted no ink drop can be cut off by the test switch M1. Further, as the groups G are each provided with a test switch M2, a voltage caused by the residual vibration of the piezo element 12 in the emission mechanism belonging to a group G not to be tested can be cut off by the test switch M2. The emission mechanism belonging to a group G not to be tested can thereby emit an ink drop without disturbing the test on the emission mechanism, and the emission mechanism can be tested even while any printing job is being carried out.

Further, the application switch P and the test switch M1 are controlled by a control signal outputted from the same data output terminal of the application switch controller 11*c* in each of the plural emission mechanisms. It is needless to provide shift registers for controlling the application switch P1 and the test switch M1 individually, and the head IC 11 can be downsized. Further, the failure deciding section 11*h*, the test switch, the application switch P and the application switch controller 11*c* are included in a single semiconductor integrated circuit. The printer 1 can thereby be downsized at lower cost.

Further, the one end of the application switch P is given a known voltage (grounded) and the other end of the application switch P is coupled with the piezo element 12 in each of the plural emission mechanisms. Then, the test switch M1 switches the other end of the application switch P between being coupled and decoupled with the test terminal T. If the one end of the application switch P is given a known voltage, the voltage is measured on the other end of the application switch P is measured at the test terminal T so that the test voltage between the source and the drain of the application switch P can be obtained according to a difference between the measured voltage and the known voltage. As the one end of the application switch P is grounded as the known voltage, in particular, the test voltage can be easily obtained according to the difference between the ground level and the voltage on the other end of the application switch P.

If the emission feasibility data SI indicates that an emission mechanism in failure emits an ink drop and an normal emission mechanism emits no ink drop, the failure handler 11*b* substitutes the emission mechanism in failure with the normal emission mechanism to be made emit an ink drop. That is, the failure handler 11*b* substitutes the emission mechanism in failure which is being unable to regularly emit an ink drop with the normal emission mechanism which is being able to regularly emit an ink drop to be made emit an ink drop. Irregular ink drop emission can thereby be prevented even if there is an emission mechanism in failure. Further, if an ink drop is emitted on the basis of the A-th emission feasibility data SI and an emission mechanism in failure is detected, an emission mechanism in failure can be substituted with a normal emission mechanism to be made emit an ink drop when an ink drop is emitted on the basis of the (A+1)-th emission feasibility data SI (next emission timing) in the same printing job. Thus, degradation in a printed image can be suppressed. Further, it is needless to stop the printing job. Further, as the emission head 10 is provided with the failure deciding section 11*h* and the failure handler 11*b*, it is needless to generate emission feasibility data SI to substitute an emission mechanism in failure with a normal emission mechanism to be made emit an ink drop. Thus, it is needless to notify a main board, etc., outside the emission head 10 of a resultant decision on the emission mechanism in failure so as to generate the emission feasibility data SI to substitute the emission mechanism in failure with the normal emission mechanism to be made emit an ink drop, and it is needless to provide a signal line for such a notice.

Further, if S, i.e., three (=M=L) or fewer out of 360 (=N) emission mechanisms emit ink drops, the pulse converter 11*e*, what obtains the joint test voltage, obtains the joint test voltage MV from the test terminal T. Thus, the failure deciding section 11*h* can decide whether the S emission mechanisms are in failure or not together on the basis of the joint test voltage MV. As the number of the emission mechanisms whose test voltages are joined to one another is three (=M=L) at most, it can be prevented that the number of the joined test voltages is too large resulting in that the joint test voltage MV is judged less precisely.

Further, the 360 (=N) emission mechanisms are divided into the groups G each being formed by three (=M) emission mechanisms. Then, if S, i.e., three (=M=L) or fewer out of three (=M) emission mechanisms belonging to the group G to be tested emit ink drops, the pulse converter 11*e* obtains the joint test voltage MV from the test terminal T. The S, i.e., three (=M=L) or fewer out of three (=M) emission mechanisms improbably emit ink drops at an emission timing while any printing job is being carried out. The number (S) of the emission mechanisms to emit ink drops included in the three (=M) emission mechanisms forming the group G to be tested is three (=M=L) or fewer with no exception, though. Thus, if S, i.e., three (=M=L) or fewer out of three (=M) emission mechanisms belonging to the group G to be tested emit ink drops, the joint test voltage MV is obtained from the test terminal T so that whether the S emission mechanisms are in failure or not can be early decided. That is, even if any printing job in which emission mechanisms to emit ink drops at the same time are unspecified is carried out by means of the printer 1 having lots of emission mechanisms (N is large), the emission mechanisms can be completely tested soon.

If all the test voltages evenly show normal voltage patterns in the S emission mechanisms, the joint test voltage MV that the test voltages in the S emission mechanisms join to one another to produce conceivably shows a normal voltage pattern. Thus, if the joint test voltage MV is not irregular, the failure deciding section 11*h* can decide that all the S emission mechanisms are normal. If the joint test voltage MV is not irregular, the failure deciding section 11*h* of the embodiment provisionally decides that all the S emission mechanisms are normal and add one to the number of times of being normal.

Meanwhile, if S is equal to or more than two and the joint test voltage MV that the test voltages in the S emission mechanisms join to one another to produce is irregular, which one of the S emission mechanisms whose test voltage is irregular cannot be uniquely identified. Thus, if S is equal to or more than two and the joint test voltage MV is irregular, it is provisionally decided that one of the S emission mechanisms is in failure and all the S emission mechanisms are enumerated as candidates for being in failure. The failure deciding section 11*h* decides whether the joint test voltage MV is irregular plural times for a single group G. Then, upon deciding that (S−1) emission mechanisms out of the S emission mechanisms enumerated as the candidates for being in failure excepting one emission mechanism are normal, the failure deciding section 11*h* decides that the relevant one emission mechanism is in failure. Thus, it is needless to repeat a process for deciding whether the joint test voltage MV is irregular or not for one and the same group G until the emission mechanism in failure alone emits an ink drop.

At this time, the more times it is decided that the joint test voltage MV is normal, the more reliably the joint test voltage MV is normal. The failure deciding section 11*h* definitely decides similarly as the embodiment that the emission mechanisms are normal if the number of times of being normal, i.e., the number of times that the joint test voltage MV is provisionally judged to be normal is equal to or more than the particular threshold for being normal (twice), so that a highly reliable test can be done.

(1-2) Test Processing

Figure 5:
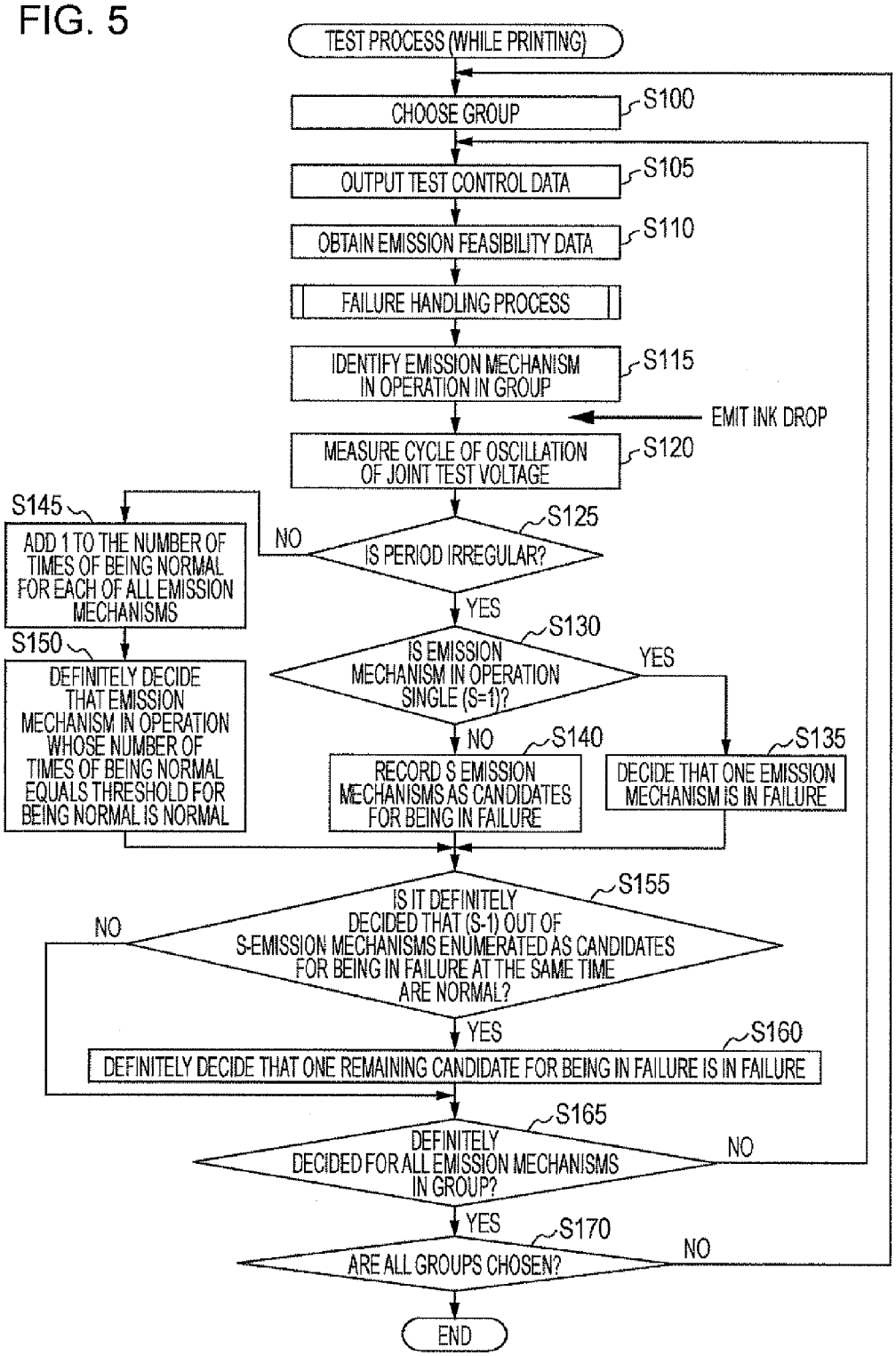
FIG. 5 is a flowchart of test processing.

FIG. 5 is a flowchart of test processing to be run by the head IC 11 in the emission head 10. The test processing is formed by processing loops to be run at each of emission timings while a printing job is being carried out. Incidentally, a printing job which allows the test processing to be run is not limited in particular. The test processing can be run in a printing job in which any printed image is formed. The switch control data generator 11*a* chooses a group G to be tested (S100). The switch control data generator 11*a* may choose a group G, e.g., in ascending order of the number n of the emission mechanism belonging to the group G. Further, if the test processing has not been completed for all the groups G in the last printing job, the switch control data generator 11*a* may choose a group G for which the test processing has not been completed in the last printing job with reference to the decision table D2. Then, the switch control data generator 11*a* generates test control data SG to turn on only a test switch M2 corresponding to the group G to be tested, and outputs the test control data SG to the test switch controller 11*d* (S105).

Then, the switch control data generator 11*a* obtains emission feasibility data SI from the emission feasibility data generating circuit 21 (S110). That is, the switch control data generator 11*a* obtains emission feasibility data SI for an emission mechanism to emit an ink drop this time. If the emission feasibility data SI is obtained, the failure handler 11*b* runs failure handling processing (described later). The failure handler 11*b* corrects the emission feasibility data SI in the failure handling processing, and the corrected emission feasibility data SI is to be processed at steps starting from S115.

The switch control data generator 11*a* identifies S emission mechanisms in operation which each emit an ink drop out of three (=M) emission mechanisms belonging to the group G to be tested on the basis of the emission feasibility data SI (S115). Then, if a latch signal LAT rises after the step 115, all emission mechanisms specified by the emission feasibility data SI for ink drop emission including the S emission mechanisms belonging to the group G to be tested emit ink drops.

The pulse converter 11*e* and the cycle measurement section 11*f* obtain the joint test voltage MV and measures the cycle p of oscillation of the joint test voltage MV (S120). That is, the test terminal T of the pulse converter 11*e* is provided with the joint test voltage MV from the application switches P of the S emission mechanisms in operation via the test switches M1 and M2 immediately after the period of time of emission pulse output. Then, the pulse converter 11*e* converts the joint test voltage MV into a test pulse MP and measures the cycle p on the basis of the test pulse MP. Then, the voltage deciding section 11*g* decides whether the cycle p is irregular or not (S125). That is, the voltage deciding section 11*g* decides that the cycle p being out of a normal range specified in the decision condition data D1 is irregular, and that the cycle p belonging to the normal range is normal.

If the cycle p is irregular (S125: Y), the failure deciding section 11*h* decides whether only one (S=1) emission mechanism in operation belongs to the group G to be tested (S130). If only one emission mechanism in operation belongs to the group G to be tested (S130: Y), the failure deciding section 11*h* definitely decides that the one emission mechanism in operation is in failure, and records the decision in the decision table D2 (FIG. 4B) (S135). Meanwhile, unless only one emission mechanism in operation belongs to the group G to be tested (S130: N), the failure deciding section 11*h* provisionally decides that all the S emission mechanism in operation are in failure, and records in the decision table D2 that all the S emission mechanism in operation are candidates for being in failure (S140). That is, if S is equal to or more than two and the joint test voltage MV is irregular, the failure deciding section 11*h* just decides that one of the S emission mechanism in operation is in failure and does not uniquely identify an emission mechanism in failure.

If the cycle p is normal (S125: N), the failure deciding section 11*h* provisionally decides that all the S emission mechanism in operation belonging to the group G to be tested are normal (S145). That is, the failure deciding section 11*h* adds one to the number of times of being normal for each of the S emission mechanisms in operation in the decision table D2. Incidentally, when the group G is initially chosen as the test object, the number of times of being normal is reset to zero for every one of the emission mechanisms in operation belonging to the group G. The failure deciding section 11*h* definitely decides that the emission mechanism in operation whose number of times of being normal equals a threshold for being normal is normal, and records the decision in the decision table D2 (S150).

Further, the failure deciding section 11*h* decides whether (S−1) out of the S emission mechanisms enumerated as the candidates for being in failure at the same time are definitely judged to be normal (S155). As the number of emission timing of enumeration as the candidate for being in failure is related to the emission mechanism in the decision table D2 as shown in FIG. 4B, the S emission mechanisms enumerated as the candidates for being in failure at the same time can be identified. If (S−1) out of the S emission mechanisms enumerated as the candidates for being in failure at the same time are definitely judged to be normal (S155: Y), the failure deciding section 11*h* definitely decides that the one emission mechanism excepting the (S−1) emission mechanisms definitely judged to be normal is in failure, and records the decision in the decision table D2 (S160). Meanwhile, unless (S−1) out of the S emission mechanisms enumerated as the candidates for being in failure at the same time are definitely judged to be normal (S155: N), the failure deciding section 11*h* shifts to a step S165 as it is. The decision table D2 is updated at each of emission timings, i.e., each time the emission feasibility data SI is outputted as explained above.

Then, the failure deciding section 11*h* decides whether a resultant decision is definitely decided for every one of the emission mechanisms belonging to the group G to be tested (S165). Then, unless a resultant decision is definitely decided for every one of the emission mechanisms belonging to the group G to be tested (S165: N), the failure deciding section 11*h* returns to the step S105 without making a next group G chosen to be tested at the step S100. That is, the failure deciding section 11*h* forbids the switch control data generator 11*a* from choosing a next group G to be tested and makes the process (starting from S105) repeated for the same group G. Meanwhile, if a resultant decision is definitely decided for every one of the emission mechanisms belonging to the group G to be tested (S165: Y), the failure deciding section 11*h* decides whether all the groups G are chosen to be tested (S170). Then, unless all the groups G are chosen to be tested (S170: N), the failure deciding section 11*h* returns to the step S100. That is, the failure deciding section 11*h* allows the switch control data generator 11*a* to choose a next group G to be tested and makes the process (starting from S105) repeated for the next group G. Meanwhile, if all the groups G are chosen to be tested (S170: Y), the failure deciding section 11*h* ends the test processing. If the printing job finishes before the test processing ends, the failure deciding section 11*h* may hold the decision table D2 at that time and continue the test processing in a next printing job.

(1-3) Failure Handling Processing

Figure 6A:
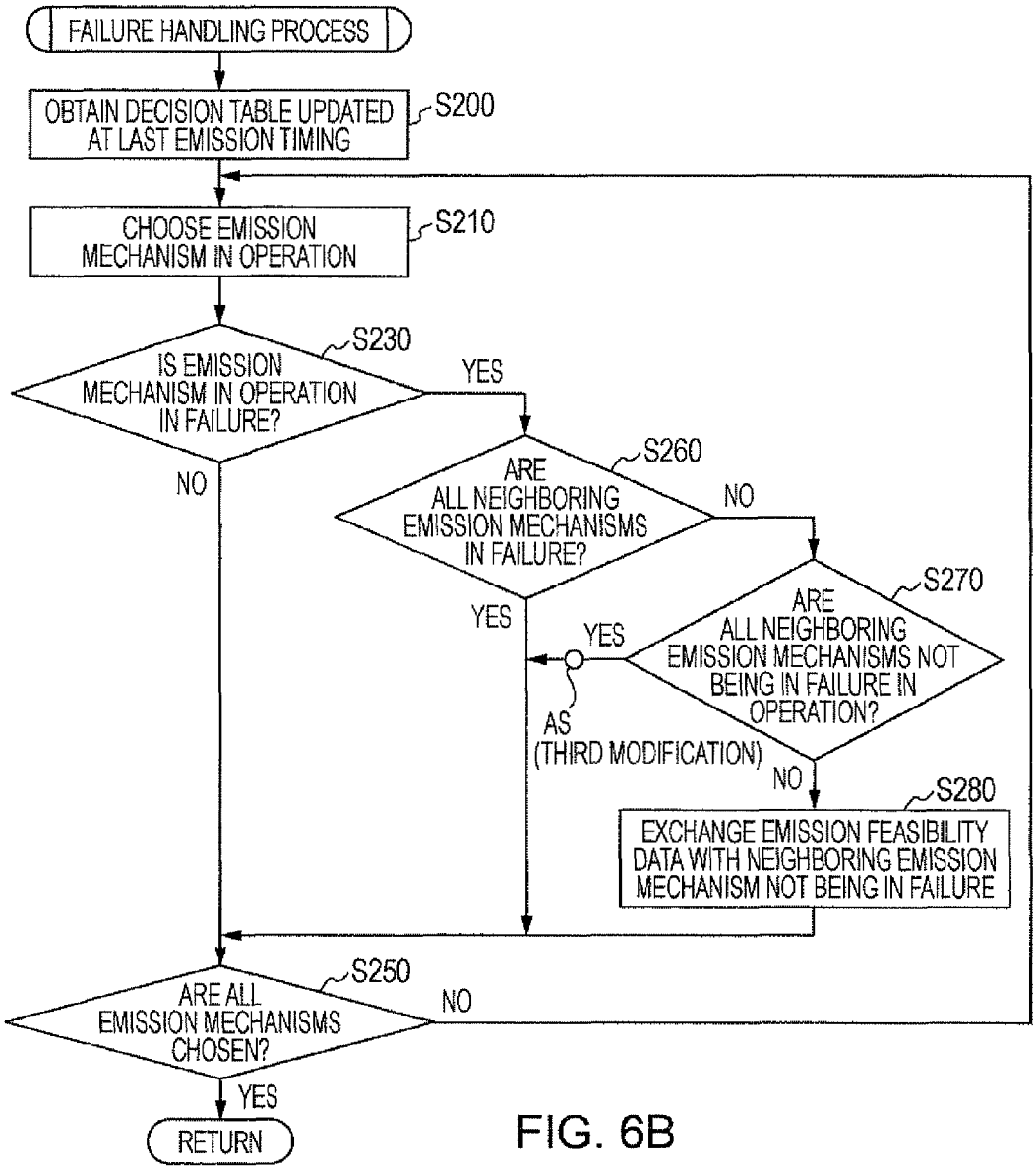
FIG. 6A is a flowchart of failure handling processing.

FIG. 6A is a flowchart of failure handling processing to be run by the failure handler 11*b*. The failure handling processing is run each time the emission feasibility data SI is obtained in the test processing shown in FIG. 5. If the emission feasibility data SI is obtained at the step S110 in FIG. 5, the failure handler 11*b* obtains the decision table D2 updated at the last emission timing. That is, if the emission feasibility data SI of the (A+1)-th emission timing is obtained at the step S110 in FIG. 5, the failure handler 11*b* obtains the decision table D2 updated at the A-th emission timing.

The failure handler 11*b* identifies emission mechanisms in operation to emit ink drops on the basis of the latest emission feasibility data SI and chooses one of the emission mechanisms in operation (S210). Then, the failure handler 11*b* decides whether the chosen emission mechanism in operation is one definitely judged to be in failure according to the decision table D2 (S230). Then, unless the chosen emission mechanism in operation is one definitely judged to be in failure according to the decision table D2 (S230: N), the failure handler 11*b* carries out a step S250 without correcting the emission feasibility data SI for the chosen emission mechanism in operation. That is, the failure handler 11*b* decides whether all the emission mechanisms in operation are chosen (S250). Then, unless all the emission mechanisms in operation are chosen (S250: N), the failure handler 11*b* returns to the step S210 and chooses a next emission mechanism in operation. Incidentally, suppose that an emission mechanism not having been tested yet (emission mechanism judged to be neither in failure nor normal) is not in failure.

Meanwhile, the chosen emission mechanism in operation is one definitely judged to be in failure according to the decision table D2 (S230: Y), the failure handler 11*b* decides whether all the neighboring emission mechanisms located next to the chosen emission mechanism are ones definitely judged to be in failure according to the decision table D2 (S260). That is, the failure handler 11*b* decides whether two emission mechanisms each emitting an ink drop of a same ink color as that of the emission mechanism in failure and having a nozzle 14 (indicated by a double circle) located closest (half the interval apart) to a nozzle 14 (indicated by a circle) that the emission mechanism in failure has in the direction perpendicular to the printing direction as shown in FIG. 3A are both emission mechanisms in failure. Then, if all the neighboring emission mechanisms are in failure (S260: Y), the failure handler 11*b* carries out the step S250 without correcting the emission feasibility data SI.

Meanwhile, if at least one of the neighboring emission mechanisms is not in failure (S260: N), the failure handler 11*b* decides whether all the neighboring emission mechanisms not being in failure are emission mechanisms in operation to emit ink drops (S270). Then, if at least one of the neighboring emission mechanisms not being in failure is not an emission mechanism in operation (S270: N), the failure handler 11*b* exchanges the emission feasibility data SI concerning the chosen emission mechanism in operation for the emission feasibility data SI concerning the neighboring emission mechanism being neither in failure nor in operation. The failure handler 11*b* can thereby substitute the chosen emission mechanism in operation being in failure with the neighboring normal emission mechanism to be made emit an ink drop. Incidentally, if there are plural neighboring emission mechanisms being neither in failure nor in operation, the failure handler 11*b* may exchange the emission feasibility data SI with any one of the neighboring emission mechanisms.

Meanwhile, if all the neighboring emission mechanisms not being in failure are emission mechanisms in operation (S270: Y), the failure handler 11*b* carries out the step S250 without correcting the emission feasibility data SI. Incidentally, upon being unable to substitute the emission mechanism in failure with the normal emission mechanism to be made emit an ink drop (S260: Y, S270: Y), the failure handler 11*b* may correct the emission feasibility data SI so that the relevant emission mechanism in operation emits no ink drop. Further, upon being unable to substitute the emission mechanism in failure with the normal emission mechanism to be made emit an ink drop (S260: Y, 5270: Y), the failure handler 11*b* may expand an area where a nozzle 14 that the neighboring emission mechanism satisfies exists.

It is supposed as to the embodiment that a decision on failure is made on the basis of the joint test voltage MV even if all the three (=M) emission mechanisms forming the group G emit ink drops. The number of the joined test voltages in the joint test voltage MV, however, may be limited to L (L<M) so that the cycle p of oscillation of the joint test voltage MV can be judged more precisely. An embodiment for limiting the number of the joined test voltages in the joint test voltage MV to L will be explained below.

Figure 6B:
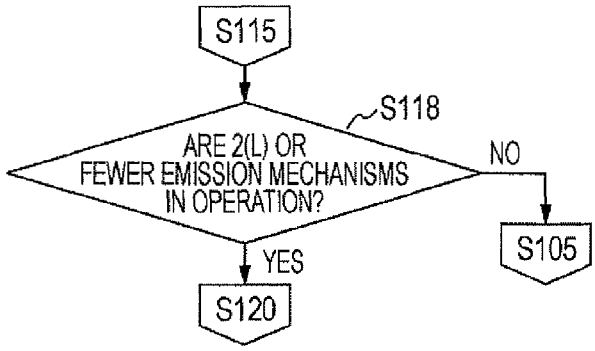
FIG. 6B is a flowchart of test processing.

FIG. 6B is (part of) a flowchart of test processing in a case where the number of the joined test voltages in the joint test voltage MV is limited to L. Incidentally, FIG. 6B shows only a process which is different from that in the test processing shown in FIG. 5. Upon identifying one in operation out of the three emission mechanisms forming the group G (FIG. 5: S115), the failure deciding section 11*h* decides whether two (=L) or fewer emission mechanisms are in operation (S118). Then, unless two or fewer emission mechanisms are in operation, the failure deciding section 11*h* returns to the step S105 (FIG. 5). That is, the failure deciding section 11*h* waits for output of the emission feasibility data SI at next emission timing without deciding whether the cycle p of the oscillation of the joint test voltage MV is irregular or not. Meanwhile, if two or fewer emission mechanisms are in operation, the failure deciding section 11*h* carries out the process at the steps starting from S120 (FIG. 5) and decides whether the cycle p of the oscillation of the joint test voltage MV is irregular or not. If the number of the joined test voltages in the joint test voltage MV for deciding whether the cycle p is irregular or not is limited to specified L in this way, the number of the joined test voltages in the joint test voltage MV can be reduced and the cycle p can be judged more precisely.

(2) First Modification

Figure 7A:
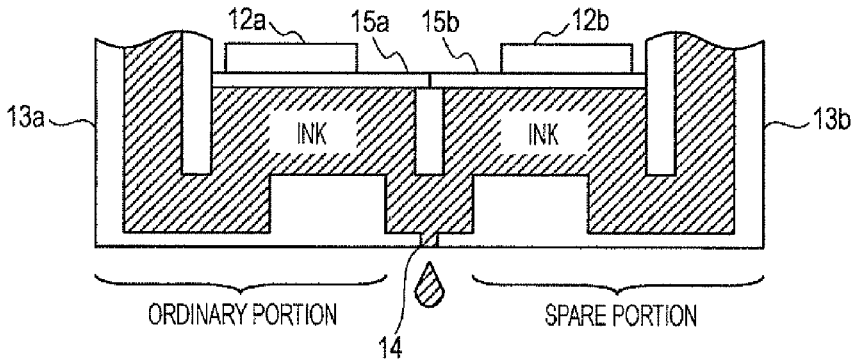
FIG. 7A schematically shows an emission mechanism of a first modification.
Figure 7B:
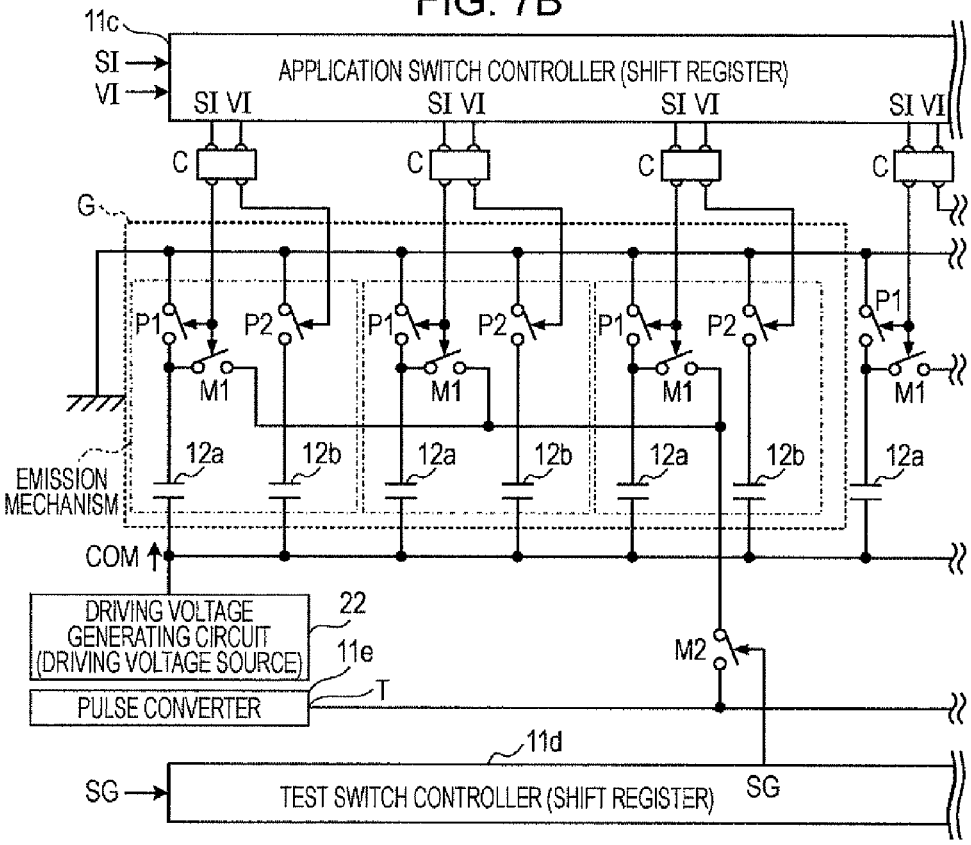
FIG. 7B is a circuit diagram of an emission head of the first modification.

FIG. 7A schematically shows a structure of an emission mechanism that an emission head 10 of a first modification has. FIG. 7B is a circuit diagram of a portion of the emission head 10 of the first modification. The emission mechanisms of the first modification each have an ordinary portion, a spare portion and a nozzle 14. The ordinary portion has a piezo element 12*a*, an ink chamber 13*a* and a vibration plate 15*a*, and the ink chamber 13*a* leads to the nozzle 14. The spare portion has a spare piezo element 12*b*, a spare ink chamber 13*b* and a spare vibration plate 15*b*, and the ink chamber 13*a* leads to the nozzle 14 as well. The structure of the emission mechanism formed by the ordinary portion and the spare portion is left to right symmetrical with respect to the nozzle 14 located in the middle in FIG. 7A. As the ink chamber 13*a* leads to the nozzle 14 and so does the spare ink chamber 13*b*, the ink chamber 13*a* and the spare ink chamber 13*b* each supply the nozzle 14 with ink.

One emission mechanism (dot-and-dash line) has a piezo element 12*a* and a spare piezo element 12*b*, which are each coupled in series with and between the ground and the driving voltage generating circuit 22 as shown in FIG. 7B. Further, an application switch P1 is coupled in series with and between the piezo element 12*a* and the ground, and so is a spare application switch P2 with and between the spare piezo element 12*b* and the ground. Thus, a driving voltage COM is applied to the piezo element 12*a* if the application switch P1 is turned on, and the driving voltage COM is applied to the spare piezo element 12*b* if the spare application switch P2 is turned on. The application switch P1 is coupled with an application switch controller 11*c* via a switching circuit C and is turned on and off by the application switch controller 11*c* and the switching circuit C, and so is the spare application switch P2. A test switch M1 coupled with and between the application switch P1 and the piezo element 12*a* switches a test voltage between being outputted from there and not being outputted. The application switch P1 and the test switch M1 are coupled with a same terminal of the switching circuit C and can be switched over between on and off similarly as each other. Meanwhile, no test switch M1 is provided correspondingly to the spare application switch P2.

Figure 8:
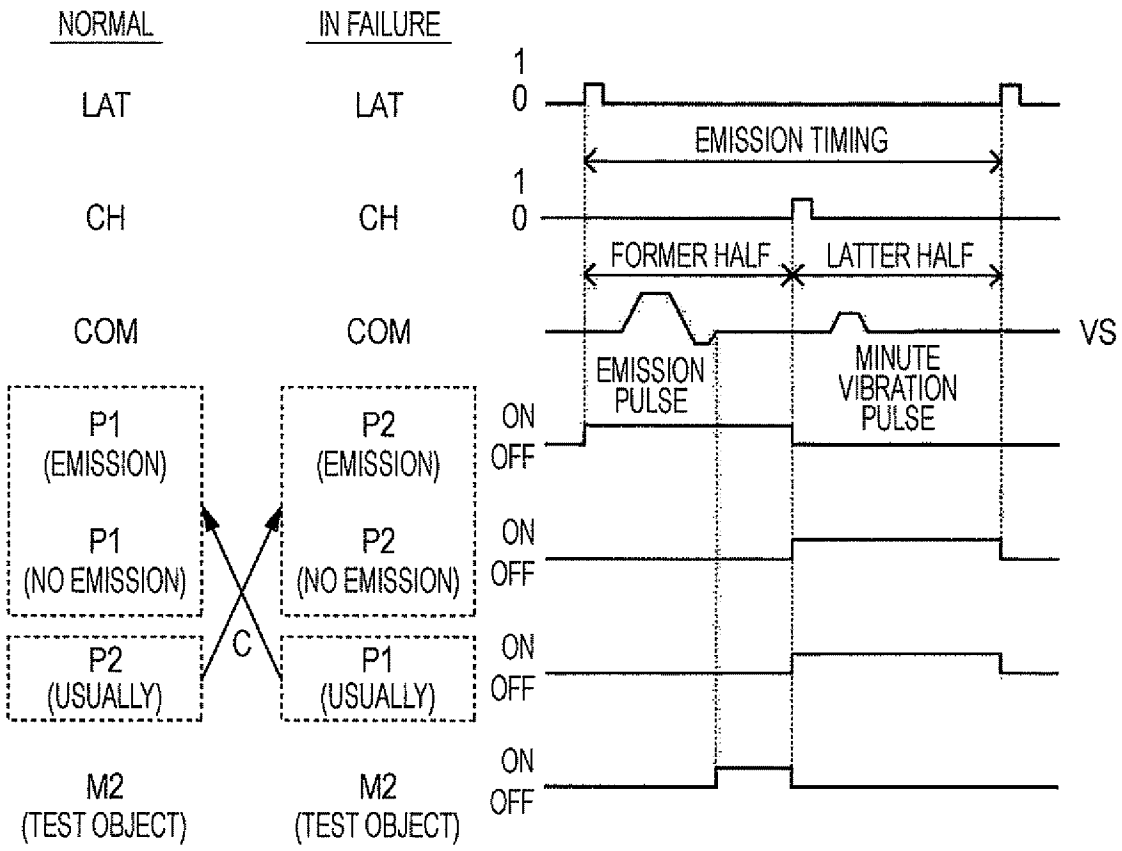
FIG. 8 is a timing chart which shows operations of switches of the first modification.

FIG. 8 is a timing chart which shows the driving voltage COM and operations of the respective switches P1, P2, M1 and M2 of the first modification. The latch signal LAT, the switching signal CH and the driving voltage COM are similar to those of the embodiment described above. The switching circuit C is a switch to exchange control signals outputted individually from the data output terminal of the application switch controller 11*c* to the application switch P1 and to the spare application switch P2 depending upon whether residual vibration of the piezo element 12*a* is normal or not.

If the residual vibration of the piezo element 12*a* is normal, the application switch controller 11*c* and the switching circuit C control the application switch P1 on the basis of the emission feasibility data SI. That is, the application switch P1 is turned on only in the former half of the emission timing if the emission feasibility data SI indicating ink drop emission is outputted, and the application switch P1 is turned on only in the latter half of the emission timing if the emission feasibility data SI indicating no ink drop emission is outputted, similarly as in the embodiment described above. Further, if the residual vibration of the piezo element 12*a* is normal, the application switch controller 11*c* and the switching circuit C control the spare application switch P2 on the basis of minute vibration data VI (FIG. 7B) which is independent of the emission feasibility data SI. That is, the spare application switch P2 is turned on only in the latter half of the emission timing independently of the emission feasibility data SI as usual.

Meanwhile, if the residual vibration of the piezo element 12*a* is irregular, the application switch controller 11*c* and the switching circuit C control the spare application switch P2 on the basis of the emission feasibility data SI. Further, if the residual vibration of the piezo element 12*a* is irregular, the application switch controller 11*c* and the switching circuit C control the application switch P1 on the basis of the minute vibration data VI which is independent of the emission feasibility data SI. That is, the application switch P1 is turned on only in the latter half of the emission timing independently of the emission feasibility data SI as usual.

According to the first modification, the group G is formed by three emission mechanisms and the test voltages outputted through the three test switches M1 included in the group G are joined to one another to be the joint test voltage MV as shown in FIG. 7B. The joint test voltage MV is outputted to the pulse converter 11*e* if the test switch M2 provided to every group G is on. The test switch M2 is turned on immediately after the emission pulse in the former half of the emission timing in a case where the group G corresponding to the relevant test switch M2 is chosen to be tested similarly as in the embodiment described above as shown in FIG. 8. Incidentally, the joint test voltage MV is a voltage which appears between the both ends of the application switch P1 in response to the residual vibration in the embodiment as well.

Figure 9A:
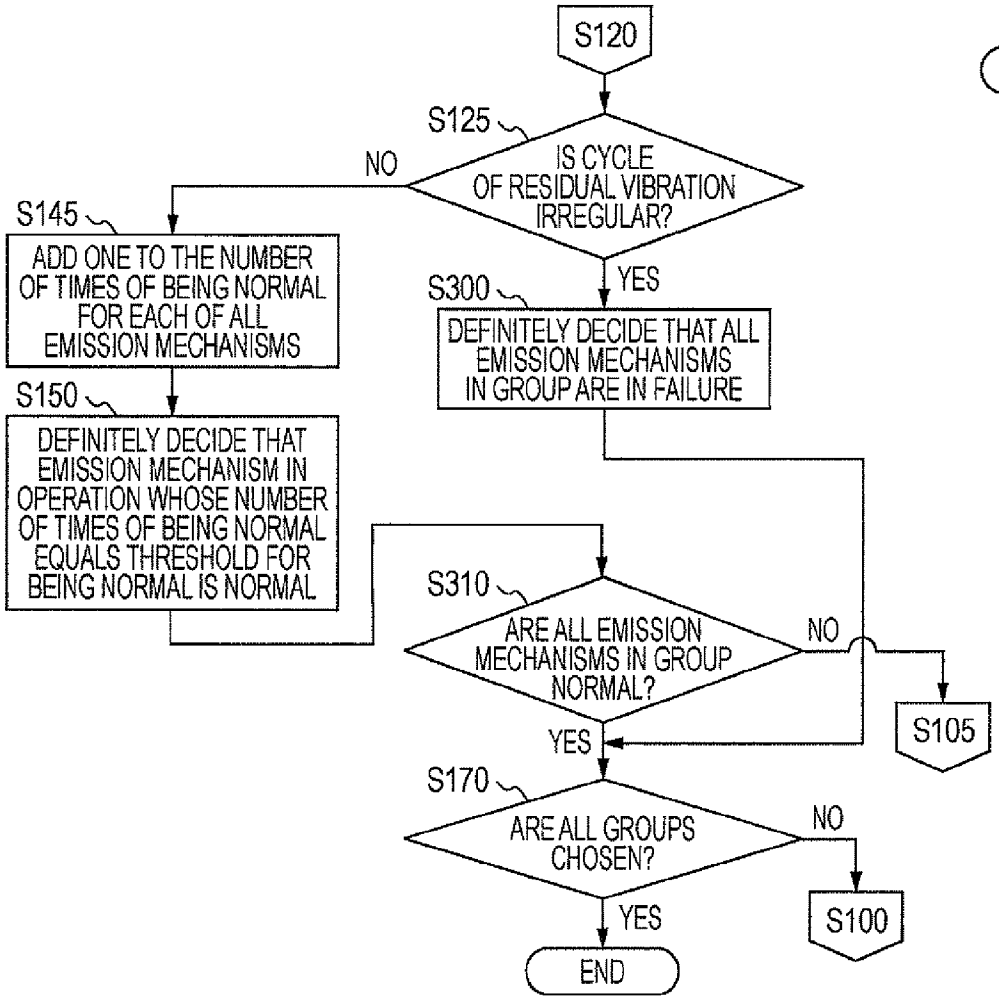
FIG. 9A is a flowchart of test processing of the first modification.

FIG. 9A is (part of) a flowchart of test processing of the first modification. FIG. 9A shows only a process having changed from that in the test processing (FIG. 5) of the embodiment described above. The voltage deciding section 11*g* decides whether the cycle p of the oscillation of the joint test voltage MV caused by the residual vibration is irregular or not (S125) similarly as in the embodiment described above. Then, if the cycle p of the oscillation of the joint test voltage MV is irregular (S125: Y), the failure deciding section 11*h* definitely decides (decides) that all the emission mechanisms belonging to the group G to be tested are in failure (S300). Upon definitely deciding that all the emission mechanisms belonging to the group G to be tested are in failure, the failure deciding section 11*h* carries out the step S170. That is, the failure deciding section 11*h* ends the test on the group G where all the emission mechanisms are definitely judged to be in failure, and chooses a next group G to be tested (FIG. 5: S100). Meanwhile, if the cycle p of the oscillation of the joint test voltage MV is normal (S125: N), the failure deciding section 11*h* adds one to the number of times of being normal for all the emission mechanisms similarly as in the embodiment described above (S145), and definitely decides that an emission mechanism in operation for which the number of times of being normal turns twice is normal (S150). Then, the failure deciding section 11*h* decides whether all the emission mechanisms belonging to the group G to be tested are definitely judged to be normal (S310). Then, unless all the emission mechanisms belonging to the group G to be tested are definitely judged to be normal (S310: N), the failure deciding section 11*h* returns to the step S105 and makes the test on the group G currently being tested carried out again. Meanwhile, if all the emission mechanisms belonging to the group G to be tested are definitely judged to be normal, the failure deciding section 11*h* returns to the step S100 and makes a test on a next group G carried out.

Figure 9B:
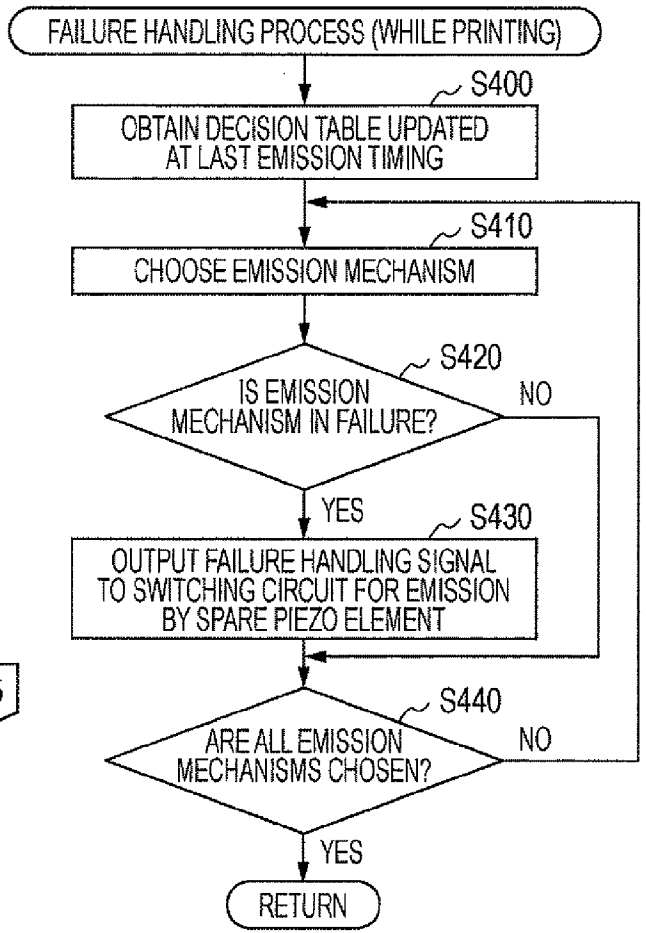
FIG. 9B is a flowchart of failure handling processing of the first modification.

FIG. 9B is a flowchart of the failure handling processing of the first modification. The failure handling processing of the first modification is run in the test processing (after the step S110 in FIG. 5) while a printing job is being carried out, as well. If the emission feasibility data SI is obtained at the step S110 in FIG. 5, the failure handler 11*b* obtains the decision table D2 updated at the last emission timing (S400). Then, the failure handler 11*b* chooses an emission mechanism to be processed (S410). Then, the failure handler 11*b* decides whether the emission mechanism to be processed is definitely judged to be in failure (S420).

If the emission mechanism to be processed is definitely judged to be in failure (S420: Y), the failure handler 11*b* switches the switching circuit C so as to make the emission mechanism to be processed emit an ink drop by driving the spare piezo element 12*b* (S430). That is, the failure handler 11*b* provides the switching circuit C with a failure handling signal for outputting a control signal based on the emission feasibility data SI to the spare application switch P2 and outputting a control signal based on the minute vibration data VI which is independent of the emission feasibility data SI to the application switch P1. Meanwhile, unless the emission mechanism to be processed is definitely judged to be in failure (S420: N), the failure handler 11*b* chooses a next emission mechanism to be processed without outputting a failure handling signal for switching the switching circuit C as to the emission mechanism to be processed (S440, S410). That is, the failure handler 11*b* makes the switching circuit C output a control signal based on the emission feasibility data SI to the application switch P1, and output a control signal based on the minute vibration data VI which is independent of the emission feasibility data SI to the spare application switch P2.

According to the configuration of the first modification explained above, if the cycle p of the oscillation of the joint test voltage MV is irregular, all the emission mechanisms belonging to the group G for which the joint test voltage MV is obtained are definitely judged to be in failure without unique identification of an emission mechanism (piezo element 12*a*) in which the test voltage is irregular. The number of times that the process is repeated for the same group G can thereby be controlled and the test processing can be completed soon. Further, as the spare piezo element 1*b* is driven so that ink drops can be regularly emitted from one and the same nozzle 14 in the group G where all the emission mechanisms are definitely judged to be in failure, degradation in a printed image formed by the ink drops can be suppressed.

Further, a minute vibration pulse is applied to the spare piezo element 12*b* at each of emission timings in each of the emission mechanisms not judged to be in failure, and a minute vibration pulse is applied to the piezo element 12*a* at each of emission timings in each of the emission mechanisms judged to be in failure as shown in FIG. 8. Thus, a piezo element 12*a* or a spare piezo element 12*b* not contributing to ink drop emission can thereby be made minutely vibrate in any one of the emission mechanisms regardless of whether definitely judged to be in failure or not, so that retention of ink can be prevented. Further, the failure deciding section 11*h* updates the decision table D2 at each of emission timings in the printing job, and at the (A+1)-th emission timing the failure handler 11*b* substitutes the piezo element 12*a* with the spare piezo element 12*b* to be made emit an ink drop in the emission mechanism judged to be in failure by the failure deciding section 11*h* at the A-th emission timing. Irregular ink drop emission can thereby be suppressed, and degradation in a printed image can be suppressed.

(3) Second Modification

An emission mechanism causing irregular residual vibration may be uniquely identified in the group G similarly as in the first embodiment in the configuration where the spare piezo element 12*b* is provided similarly as in the first modification. That is, if an emission mechanism causing irregular residual vibration is uniquely identified in the group G similarly as in the first embodiment, the failure handler 11*b* may switch the switching circuit C so as to substitute the piezo element 12*a* with the spare piezo element 12*b* to be made emit an ink drop only in the identified emission mechanism.

(4) Third Modification

Figure 10B:
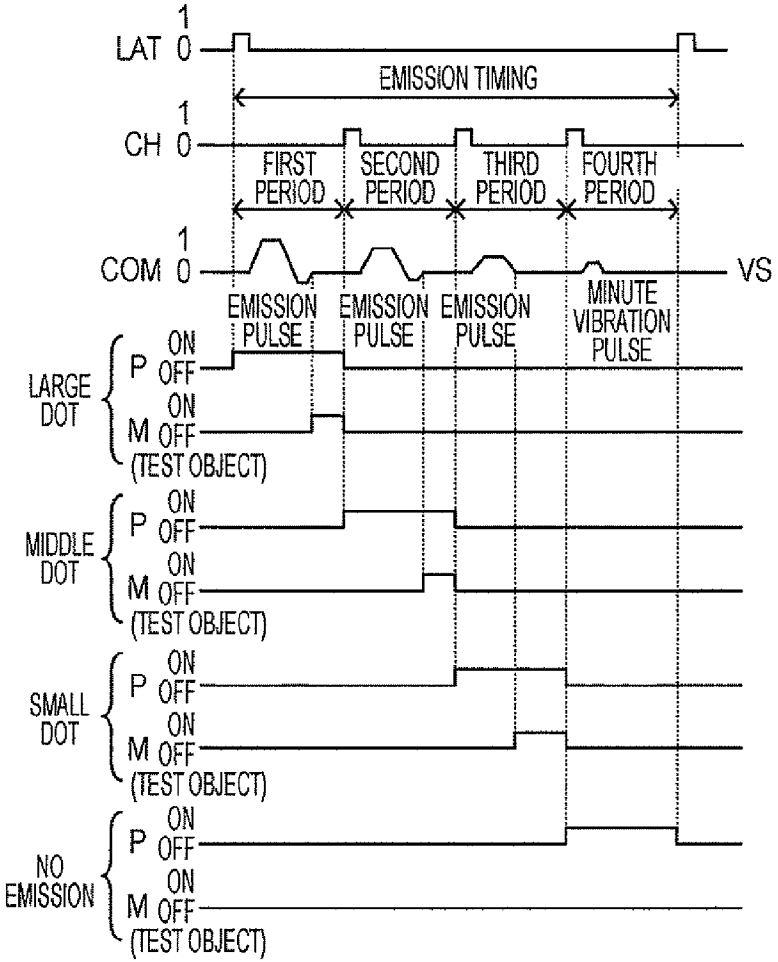
FIG. 10B is a timing chart which shows a driving voltage and operations of test switches of the third modification.
Figure 10A:
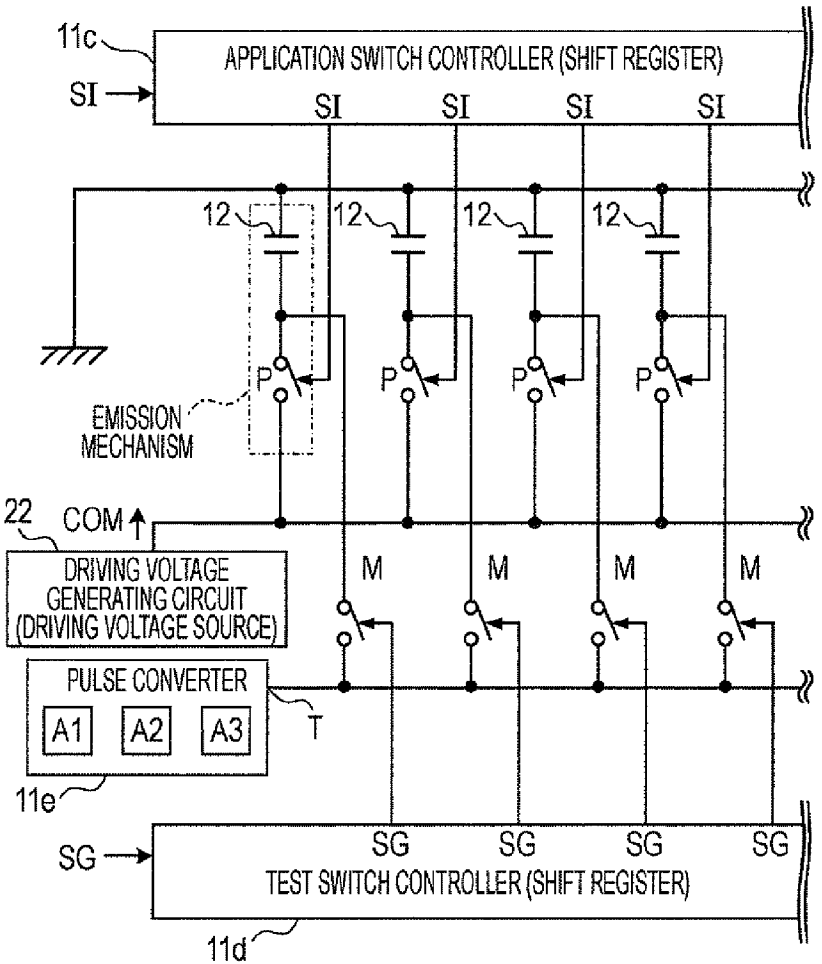
FIG. 10A is a circuit diagram of a driving circuit of a third modification.

FIG. 10A is a circuit diagram of part of an emission head 10 of a third modification. The driving voltage generating circuit 22, the application switch P, the piezo element 12 and the ground are coupled in series in the third modification. The application switch P1 is coupled closer to the driving voltage generating circuit 22, not to the ground, than the piezo element 12*a*. The one end of the application switch P is coupled with the driving voltage generating circuit 22, and the other end of the application switch P is coupled with the test terminal T of the pulse converter 11*e* via the test switch M. If the test switch M is on, the other end of the application switch P and the test terminal T of the pulse converter 11*e* are given a same voltage. The test switch M is provided correspondingly to each of the emission mechanisms. The test switch controller 11*d* switches the test switch M for each of the emission mechanisms on the basis of the test control data SG. The switch control data generator 11*a* of the embodiment turns on only a test switch corresponding to one emission mechanism to be tested and turns off all the test switches M corresponding to the remaining emission mechanisms. That is, the test is carried out on an emission mechanism-by-emission mechanism basis, not on a group G-by-group G basis according to the third modification.

FIG. 10B is a timing chart which shows the driving voltage COM and operations of the switches P and M of the third modification. One period of the emission timing is demarcated into first to fourth periods by the switching signal CH. The driving voltage COM is generated to be same at each of emission timings and is a known voltage pattern. The driving voltage COM includes an emission pulse for emitting a large ink drop to form a large dot in the first period. The driving voltage COM includes an emission pulse for emitting a middle ink drop to form a middle dot in the second period. The driving voltage COM includes an emission pulse for emitting a small ink drop to form a small dot in the third period. The driving voltage COM includes a minute vibration pulse for making the piezo element 12 minutely vibrate in the fourth period. Incidentally, the large ink drop is largest in volume, and the small ink drop is smallest in volume. Further, the driving voltage COM equals the reference voltage VS for a period of time excepting the periods of time for emission pulse output and minute vibration pulse output.

The application switch P is turned on in the first period in a case where the emission mechanism emits a large ink drop. Further, the test switch M is turned on immediately after the period of time for emission pulse output in the first period in a case where the emission mechanism emits a large ink drop and is chosen to be tested. The application switch P is turned on in the second period in a case where the emission mechanism emits a middle ink drop. Further, the test switch M is turned on immediately after the period of time for emission pulse output in the second period in a case where the emission mechanism emits a middle ink drop and is chosen to be tested. The application switch P is turned on in the third period in a case where the emission mechanism emits a small ink drop. Further, the test switch M is turned on immediately after the period of time for emission pulse output in the third period in a case where the emission mechanism emits a small ink drop and is chosen to be tested. The application switch P is turned on in the fourth period in a case where the emission mechanism emits no ink drop.

The driving voltage COM equals the reference voltage VS in a case where the test switch M is turned on immediately after a period of time for emission pulse output. Thus, subtract the reference voltage VS from the voltage on the test terminal T of the pulse converter 11*e* in the period of time for which the test switch M is on, so that the test voltage which appears between the source and the drain of the application switch P can be obtained. Further, as a test voltage caused by residual vibration is composed by alternating components, the test voltage can be obtained upon a direct component corresponding to the reference voltage VS being removed by means of a capacitor, etc. That is, the voltage level of the reference voltage VS in the driving voltage COM need not be exactly known. If it is known that VS is a certain direct component, the test voltage caused by the residual vibration between the source and the drain of the application switch P can be extracted. According to the configuration explained above, the test voltage which indicates conditions of the residual vibration can be obtained for every emission mechanism chosen to be tested, and whether the residual vibration is irregular or not can be decided on the basis of the test voltage for every emission mechanism chosen to be tested. Further, the test voltage can be obtained in any case where the chosen emission mechanism emits a large, middle or small ink drop.

The pulse converter 11*e* generates a test pulse MP by rendering the test voltage inputted to the test terminal T binary. The pulse converter 11*e* has an amplifier circuit which amplifies the test voltage which is the reference voltage VS subtracted from the voltage on the test terminal T, and a binary circuit which renders the test voltage amplified by the amplifier circuit binary. The binary circuit generates a test pulse MP whose signal level is 1 for a period of time when the test voltage is equal to or higher than a particular threshold voltage. The pulse converter ile of the third modification has first to third amplifier circuits A1-A3, three amplifier circuits in all, and a switch (not shown). The switch allows the test voltage to be provided to the first amplifier circuit A1, the second amplifier circuit A2 and the third amplifier circuit A3 in the first, second and third periods, respectively. The first amplifier circuit A1 has a smallest gain and the third amplifier circuit A3 has a largest gain in the first to third amplifier circuits A1-A3. That is, the smaller in volume an emitted ink drop is, the more the gain for the test voltage MV is increased. The smaller in volume an emitted ink drop is, the smaller the amplitude of the test voltage MV before being amplified is. The test voltage MV after being amplified can have a variation range including the threshold voltage by increasing the gain, though. Thus, increase the gain for the test voltage MV more as an emitted ink drop is smaller in volume, so that a test pulse MP matching the test voltage MV can be generated even if the emitted ink drop is small in volume.

The test voltage MV has a cyclic waveform which decays in amplitude as time t passes. Then, if the residual vibration decays as time t passes resulting in that the amplitude of the amplified test voltage MV does not include the particular threshold voltage, the signal level of the test pulse MP will not change. The head IC 11 of the third modification has a decay period measurement section (not shown) instead of the cycle measurement section 11*f* (FIG. 1). The decay period measurement section identifies a period of time from the time when the period of time for emission pulse output ends to the time when the signal level of the test pulse MP finally changes as a decay period. The voltage deciding section 11*g* reads a range of normal decay time from the decision table D2 for each of the first to third periods, and decides that the test voltage is normal if the decay period measured by the decay period measurement section belongs to the range of normal decay time. Incidentally, the decay period is shortest in the third period when a small ink drop is emitted, as the amplitude of the piezo element 12 (vibration plate 15) is smaller in the third period than in the first and second periods when large and middle ink drops are emitted. As the gains of the first to third amplifier circuits A1-A3 differ from one another, though, the range of normal decay time is not necessarily set shorter in the third period than in the first period. Incidentally, the higher ink viscosity is in the ink chamber 13, the shorter the decay time is, and thus the decay time belonging to the range of normal decay time implies that the ink viscosity is normal in the ink chamber 13. That is, an emission mechanism in failure of the third modification implies that the ink viscosity is irregular in the ink chamber 13. As the voltage deciding section 11*g* of the third modification decides whether the test voltage is normal or not for every emission mechanism, the failure deciding section 11*h* records a resultant decision on the test voltage (decay time) in the decision table D2 for every emission mechanism.

FIG. 11A shows an exemplary decision table D2 recorded in the third modification. The 31st to 33rd emission mechanisms are chosen to be tested in turn in FIG. 11A. The failure deciding section 11*h* adds one to the number of times of being normal in the decision table D2 if a test voltage obtained in any of the first to third periods is judged to be normal. Then, if the number of times of being normal equals two, the failure deciding section 11*h* definitely decides that the emission mechanism is normal. The failure deciding section 11*h* definitely decides that the emission mechanism to be tested is in failure in the decision table D2 if a test voltage obtained in any of the first to third periods is judged to be irregular. That is, a threshold for being normal as to the number of times of being normal is twice, and a threshold for being in failure as to the number of times of being in failure is once, according to the third modification. Let the threshold for being normal as to the number of times of being normal be twice, so that it can be carefully definitely decided that the emission mechanism is normal, and that missed detection of an emission mechanism in failure can be prevented.

Upon definitely deciding whether the emission mechanism to be tested is normal or in failure, the failure deciding section 11*h* allows the switch control data generator 11*a* to choose a next emission mechanism to be tested. The switch control data generator 11*a* thereby chooses the next emission mechanism to be tested, and generates test control data SG to turn the test switch M on only in the relevant emission mechanism. Incidentally, what is tested before a test result is definitely judged concerning the emission mechanism to be tested is not necessarily limited to the relevant emission mechanism. Another emission mechanism may be provisionally chosen to be tested at an emission timing when the relevant emission mechanism emits no ink drop. At the 208th emission timing in FIG. 11A, e.g., the 33rd emission mechanism not having been tested may be a provisional test object, and whether the test voltage is normal or not may be decided. Then, at the 209th emission timing when the 32nd emission mechanism emits an ink drop, the 32nd emission mechanism may be a test object, and whether the test voltage is normal or not may be decided.

FIG. 11B shows another exemplary decision table D2 recorded according to the third modification. In FIG. 11B, a numeral written in a column of an emission mechanism to be tested indicates not the number of times of being normal but a comprehensive index. If a test voltage obtained in the first period is normal, the failure deciding section 11*h* does not add one to the number of times of being normal but does add an index, 2, which is the number of times of being normal, 1, multiplied by a weighting coefficient, 2, to the comprehensive index. If a test voltage obtained in the second period is normal, the failure deciding section 11*h* adds an index, 1, which is the number of times of being normal, 1, multiplied by a weighting coefficient, 1, to the comprehensive index. Further, if a test voltage obtained in the third period is normal, the failure deciding section 11*h* adds an index, 0.5, which is the number of times of being normal, 1, multiplied by a weighting coefficient, 0.5, to the comprehensive index. That is, the failure deciding section 11*h* sums up indices each being the number of times that the test voltage is judged to be normal multiplied by a weighting coefficient which is larger as an ink drop is larger in volume so as to calculate a comprehensive index. Then, if the comprehensive index is equal to or more than the particular threshold, 2, the failure deciding section 11*h* definitely decides that the emission mechanism to be tested is normal.

In FIG. 11B, e.g., if the number of times of being normal, i.e., how many times the test voltage is normal after a large ink drop is emitted, is equal to or more than one, it is definitely decided that the emission mechanism is normal. Further, if the number of times of being normal, i.e., how many times the test voltage is normal after a middle ink drop is emitted is equal to or more than two, it is definitely decided that the emission mechanism is normal. Further, if the number of times of being normal, i.e., how many times the test voltage is normal after a small ink drop is emitted is equal to or more than four, it is definitely decided that the emission mechanism is normal. That is, as the emitted ink drop is smaller in volume, the threshold of the number of times of being normal for definitely deciding that the emission mechanism is normal is larger, e.g., in FIG. 11B.

If a small ink drop is emitted, the test voltage is amplified by the largest gain. Thus, if a small ink drop is emitted and a minute noise voltage is mixed into the test voltage, a pulse corresponding to the noise voltage possibly appears on the test pulse MP. That is, as an ink drop emitted when the test voltage is obtained is smaller, a noise component more probably appears on the test pulse MP and a resultant decision on the test voltage based on the test pulse MP is rendered less reliable. On the other hand, as an ink drop emitted when the test voltage is obtained is larger, a noise component less probably appears on the test pulse MP and a resultant decision on the test voltage based on the test pulse MP is rendered more reliable. Thus, whether an emission mechanism is normal or not is decided on the basis of a comprehensive index which is a sum of indices multiplied by weighting coefficients which are larger as an ink drop is larger in volume, so that whether the emission mechanism is normal or not can be decided while a reliable resultant decision on a test voltage is being regarded as important.

The failure handling processing (FIG. 6) of the third modification may be changed as follows. That is, if all the neighboring emission mechanisms excepting the emission mechanisms in failure are in operation (S270: Y), the failure handler 11*b* may correct the emission feasibility data SI so as to make an ink drop to be emitted by one of the neighboring emission mechanisms excepting the emission mechanisms in failure larger in volume. Further, the spare piezo element 12*b* of an emission mechanism in failure of the third modification may be made emit an ink drop.

(5) Other Modifications

The spare piezo element 12*b* of an emission mechanism definitely judged to be in failure may be made emit an ink drop in a configuration where the control switch M is controlled for every emission mechanism so that every emission mechanism is tested as in the third modification.

The embodiment described above is of an example such that a test apparatus tests an emission mechanism to emit an ink drop. The test apparatus may test an emission mechanism to emit a liquid drop excepting an ink drop. That is, the emission mechanism may form a planar or solid structure by the emitted liquid drop. The liquid drop may be some material to form a planar or solid structure. Further, the emission mechanism may emit liquid for processing (washing, etching, etc.) to be done where the liquid drop arrives. Further, the test processing is run while a printing job is being carried out according to the embodiment described above. The test processing may be run while a particular test image is being printed. Further, the test processing is run in parallel with the failure handling processing. The printer 1 may run only the test processing and may stop a printing job if there is an emission mechanism in failure. Further, the liquid drop is not limited to one emitted by pressure due to a mechanical change in a piezoelectric element, and may be emitted by pressure due to bubble generation. Further, a test parameter excepting the cycle p of the residual vibration or the decay period may be obtained on the basis of the joint test voltage. An irregular matter excepting a bubble mixed into the ink chamber 13 or irregular ink viscosity may be tested on the basis of a test parameter excepting the cycle p of the residual vibration or the decay period as a matter of course.

The entire disclosure of Japanese Patent Application No 2012-010775, filed Jan. 23, 2012 is expressly incorporated by reference herein.

What is claimed is:

1. A test apparatus for a liquid drop emission apparatus having a plurality of emission mechanisms, the emission mechanisms each having a driving element configured to emit an ink drop from a nozzle, and an application switch coupled with a driving voltage source and the driving element in series, the application switch being configured to switch a driving voltage for emission of a liquid drop between being applied and not being applied to the driving element, the test apparatus comprising:

a test switch configured to make each of the emission mechanisms output a test voltage which appears between both ends of the application switch to a test terminal; and a failure deciding section configured to decide whether the emission mechanism is in failure or not on the basis of the test voltage outputted to the test terminal.

2. The test apparatus according to claim 1 further comprising a shift register configured to shift nozzle selection data formed by emission feasibility data serially combined in order of the plural emission mechanisms, the emission feasibility data specifying whether a liquid drop is to be emitted or not by each of the plural emission mechanisms, the shift register being configured to output a control signal based on the emission feasibility data from a data output terminal to the application switch of each of the emission mechanisms, wherein the application switch and the test switch are controlled by the control signal outputted from the same data output terminal of the shift register in each of the emission mechanisms.

3. The test apparatus according to claim 2, wherein the failure deciding section and the test switch are included with the application switch and the shift register together in a single semiconductor integrated circuit.

4. The test apparatus according to claim 1, wherein in each of the plural emission mechanisms:

the one end of the application switch is given a known voltage and the other end of the application switch is coupled with the driving element; and the test switch switches the other end of the application switch between being coupled and decoupled with the test terminal.

5. The test apparatus according to claim 4, wherein the one end of the application switch is grounded in each of the plural emission mechanisms.

6. The test apparatus according to claim 4, wherein the one end of the application switch is coupled with the driving voltage source which generates the driving voltage of a known voltage pattern in each of the plural emission mechanisms.

* * * * *